US010351958B2

(12) United States Patent
Dwyer et al.

(10) Patent No.: US 10,351,958 B2
(45) Date of Patent: Jul. 16, 2019

(54) SYSTEMS AND METHODS FOR ELECTROLESS PLATING OF THIN GOLD FILMS DIRECTLY ONTO SILICON NITRIDE AND INTO PORES IN SILICON NITRIDE

(71) Applicant: Rhode Island Board of Education, State of Rhode Island and Providence Plantations, Providence, RI (US)

(72) Inventors: Jason Rodger Dwyer, Providence, RI (US); Julie C. Whelan, Charlestown, RI (US); Y. M. Nuwan D. Y. Bandara, Kingston, RI (US); Buddini I. Karawdeniya, Kingston, RI (US)

(73) Assignee: Council On Postsecondary Education, Warwick, RI (US)

( * ) Notice: Subject to any disclaimer, the term of this patent is extended or adjusted under 35 U.S.C. 154(b) by 0 days.

(21) Appl. No.: 15/319,118

(22) PCT Filed: Jun. 22, 2015

(86) PCT No.: PCT/US2015/036965

§ 371 (c)(1),
(2) Date: Dec. 15, 2016

(87) PCT Pub. No.: WO2015/196195

PCT Pub. Date: Dec. 23, 2015

(65) Prior Publication Data

US 2017/0130338 A1 May 11, 2017

Related U.S. Application Data

(60) Provisional application No. 62/014,966, filed on Jun. 20, 2014.

(51) Int. Cl.

| | |
|---|---|
| ***C23C 18/16*** | (2006.01) |
| ***C23C 18/18*** | (2006.01) |
| ***C23C 18/42*** | (2006.01) |

(52) U.S. Cl.

CPC ..... *C23C 18/42* (2013.01); *C23C 18/1608* (2013.01); *C23C 18/1612* (2013.01); *C23C 18/1633* (2013.01); *C23C 18/18* (2013.01); *C23C 18/1851* (2013.01); *C23C 18/1893* (2013.01); *C23C 18/1844* (2013.01)

(58) Field of Classification Search

None

See application file for complete search history.

(56) References Cited

U.S. PATENT DOCUMENTS

| | | | | |
|---|---|---|---|---|
| 4,419,390 | A * | 12/1983 | Feldstein | C23C 18/34 427/304 |
| 5,332,697 | A * | 7/1994 | Smith | H01L 21/3144 257/E21.268 |
| 2002/0197389 | A1 | 12/2002 | Buriak et al. | |
| 2007/0108404 | A1 | 5/2007 | Stewart et al. | |
| 2012/0145554 | A1* | 6/2012 | Liu | C23C 18/161 205/187 |
| 2012/0256224 | A1* | 10/2012 | Hatanaka | C23C 18/1608 257/98 |
| 2014/0072796 | A1 | 3/2014 | Malone et al. | |
| 2014/0093647 | A1* | 4/2014 | Rzeznik | C23C 18/165 427/302 |

OTHER PUBLICATIONS

International Search Report and the Written Opinion issued by the International Searching Authority dated Sep. 16, 2015 in related International Application No. PCT/US2015/036965.

International Preliminary Report on Patentability issued by the International Bureau dated Dec. 29, 2016 in related International Application No. PCT/US2015/036965.

Menon et al. Fabrication and Evaluation of Nanoelectrode Ensembles. Analytical Chemistry. Apr. 18, 1995. [retrieved on Jun. 11, 2015] (42 pages).

* cited by examiner

*Primary Examiner* — Shamim Ahmed

(74) *Attorney, Agent, or Firm* — Milstein Zhang & Wu, LLC; Duan Wu, Esq.

(57) ABSTRACT

A method is disclosed for electroless plating of thin metal film directly onto a substrate. The method includes the steps of: cleaning the substrate to remove organic material; etching a surface of the substrate to remove an oxygen-containing surface layer; soaking and rinsing the substrate in a plurality of baths following etching; and electroless plating the metal onto the substrate.

13 Claims, 23 Drawing Sheets

SYSTEMS AND METHODS FOR ELECTROLESS PLATING OF THIN GOLD FILMS DIRECTLY ONTO SILICON NITRIDE AND INTO PORES IN SILICON NITRIDE

PRIORITY

This application claims priority to International Patent Application Serial No. PCT/US2015/036965 filed Jun. 22, 2015, as well as U.S. Provisional Patent Application Ser. No. 62/014,966 filed Jun. 20, 2014, the disclosures of which are hereby incorporated by reference in their entirety.

GOVERNMENT SUPPORT

This invention was made with U.S. government support under Grant No. CBET1150085 awarded by the National Science Foundation, as well as EPSCoR Cooperative Research Agreement No. IIA-1330406 also awarded by the National Science Foundation. The U.S. government has certain rights in the invention.

BACKGROUND

The invention generally relates to the formation of thin gold films, and relates in particular the forming of thin gold films using electroless plating techniques.

Gold films, and in particular, thin gold films have widespread technological utility, from forming conductive elements and overlayers, to serving as a platform for chemical surface modification by molecular self-assembly. For gold films incorporated into conventional micro- and nanofabricated devices, silicon nitride is an appealing choice for a substrate. It is a standard nanofabrication material, offering, in addition, favorable inherent properties such as mechanical strength, chemical resistance, and dielectric strength. Silicon nitride is thus ubiquitous as a structural and functional element in nanofabricated devices, where it plays a variety of roles.

The surface chemistry of silicon nitride, however, presents special challenges given the complex mixture of silicon-, oxygen-, and nitrogen-bearing surface species. The nominal surface modification of silicon nitride is frequently carried out in practice using silane-based modification of a silica layer that may itself not be well-defined. Thus, there remains both a need and opportunity to expand the suite of approaches useful for surface functionalizing silicon nitride directly.

Electroless deposition is a particularly compelling approach to film formation for a variety of reasons. For one, deposition proceeds from solution allowing the coating of three-dimensional surfaces, including surfaces hidden from line-of-sight deposition methods. Also, no electrochemical instrumentation is required; no electrical power must be supplied nor must the substrate be conductive; there is no need for expensive vacuum deposition equipment. Further, a variety of classical physicochemical parameters such as reagent composition, solution properties such as pH and viscosity, and temperature, are available to tune the film properties.

There are many approaches for the electroless plating of substrates such as polymers, for example, but no established techniques for the direct metal-cation-mediated electroless plating of gold onto silicon nitride. One interesting sequence exists for the electroless gold plating of poly(vinylpyrrolidone)-coated polycarbonate substrates (Au/PVP): direct sensitization of the PVP surface with $Sn^{2+}$, activation by immersion in ammoniacal silver nitrate to oxidize the surface $Sn^{2+}$ to $Sn^{4+}$ by reducing $Ag^{+}$ to elemental silver (producing, also, a small amount of silver oxide), and finally gold plating by galvanic displacement of the silver with reduction of Au(I) to Au(0) accompanied by the oxidation of formaldehyde. Amine and carbonyl groups in the PVP layer were proposed to complex the tin cation during sensitization.

Extending this approach, $Sn^{2+}$ has been reported to complex effectively with oxygen-rich polymer surfaces and with quartz and silica substrates. Tin(II) sensitization has also been reported on NaOH-roughened surfaces, suggesting that a specific chemical interaction may not be essential, and underscoring the utility of electroless plating for rough and high-surface-area surfaces where physical deposition is challenged.

In principle, though, a smooth silicon nitride substrate with a well-defined silica surface layer should be amenable to direct tin sensitization. Electroless deposition of gold on planar silicon nitride however, has been limited to routes requiring the use of a silica layer with organic linkers and metal layers between the silicon nitride and gold overlayer. In the first case, covalent attachment of an organic monolayer using silane chemistry can be beneficial for film adhesion, but adds operational complexity and can constrain downstream processing conditions. In the second case, the intervening layers may lend beneficial properties, or may similarly introduce compositional constraints on applications, or morphological constraints on the final gold film nanostructure. Regardless of the ability to carry out a silica-based modification, it does not eliminate the benefits of a direct functionalization of silicon nitride.

There remains a need therefore, for an improved method for providing plating of gold onto silicon nitride thin films without the above discussed shortcomings.

SUMMARY

In accordance with an embodiment, the invention provides a method of providing electroless plating of thin metal film directly onto a substrate. The method includes the steps of: cleaning the substrate to remove organic material; etching a surface of the substrate to remove an oxygen-containing coating; soaking and rinsing the substrate following etching, and electroless plating the metal onto the substrate.

In accordance with another embodiment, the invention provides a method of providing electroless plating of thin gold film directly onto a substrate. The method includes the steps of: cleaning the substrate to remove organic material; etching the surface of the substrate to remove an oxygen-containing coating; applying a mask to form a patterned surface on the substrate; soaking and rinsing the substrate using an alcohol using a plurality of baths following etching, and electroless plating gold onto the substrate.

In accordance with a further embodiment, the invention provides a thin film of silicon nitride with an electroless plating of a thin gold film thereon without an intermediate material between the silicon nitride and the thin gold film.

BRIEF DESCRIPTION OF THE DRAWINGS

The following description may be further understood with reference to the accompanying drawings in which.

DETAILED DESCRIPTION

Figure 1:
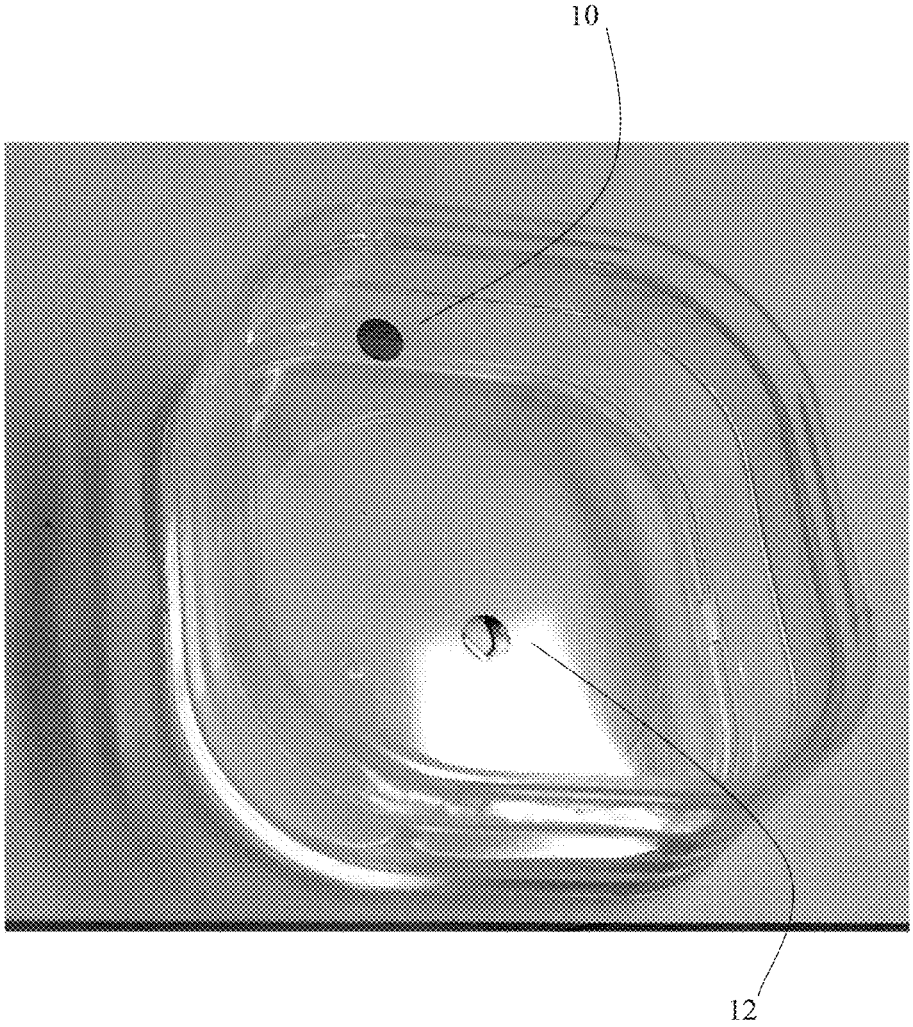
FIG. 1 shows an illustrative view of an untreated disc of silicon nitride (top disc) and a silicon nitride disc after electroless plating (bottom disc) in accordance with an embodiment of the invention.

In accordance with an embodiment, the invention provides a method to directly electrolessly plate silicon-rich silicon nitride with thin gold films was developed and characterized. In certain embodiments, an $Sn^{2+}$ initial treatment may be used to deposit gold everywhere on the substrate versus film patterning with 254 nm-irradiated substrate exposed to 1-alkene (or 1-alkyne) followed by $Pd^{2+}$ or $Ag^{+}$ solutions as initial treatments in the case of a patterned gold film. Films with thicknesses <100 nm were grown at 3 and 10° C. between 0.5 and 3 h, with mean grain sizes between ~20 and 30 nm. The method is compatible with plating free-standing ultrathin silicon nitride membranes, and the interior walls of micropore arrays in 200 nm thick silicon nitride membranes were successfully plated. The method is thus amenable to coating planar, curved, and line-of-sight-obscured silicon nitride surfaces.

A process sequence of the invention, therefore, successfully used the direct electroless plating of gold onto silicon nitride. The sequence including a pre-cleaning step following by the sensitization of silicon nitride surface and finally by electrolessly plating gold onto the desired surface. The surface area can be of any shape and size depending upon the conditions used.

An electroless gold deposition method is therefore presented in which the initial covalent attachment of an organic monolayer to the substrate is eliminated, and in which there is no need to initially prepare the silicon nitride surface chemistry with a silica overlayer. The method directly sensitizes the silicon nitride substrate with a $Sn^{2+}$ solution, followed by a series of metal ion treatments in which control over the gold film thickness is exerted using process time and temperature. Film thicknesses ranged from 30 to 100 nm for deposition times from 0.5 to 3 h, and temperatures of 3 and 10° C.

Important elements of aspects of the invention include 1) an etch to remove an oxygen-containing surface layer is used to electrolessly plate directly onto silicon nitride, the direct plating being enabled by the etching, and 2) because of the etch, an organic monolayer may be attached in selected areas of the surface in order to control where the gold film is able to plate. These steps will work on silicon nitride and silicon.

Applications of this technology include coating silicon nitride AFM tips, nanowire deposition for microelectrodes, decorative coatings, and gold-coating silicon-nitride-coated biomedical devices such as single-particle micropore sensors and single-molecule and single-particle nanopore sensors to allow for gold-thiol thin-film self-assembly to tune surface chemistry. This procedure makes it possible to electrolessly gold plate onto silicon nitride without the need for expensive vacuum coating equipment or prior deposition of other metals to render the substrate conductive for standard electrochemical deposition. In contrast to traditional gas-phase metal film deposition, which requires line-of-sight access to the substrate, immersion of the piece in the plating bath can drive film formation at interfaces that are not visible.

The silicon nitride substrate is commonly used in a variety of fields, including for example, in electronic, automotive, and biomedical devices. The use of electroless gold plating can produce gold films and film-type architectures such as planar electrodes without the need for traditional and expensive deposition equipment that requires the direct input of electrical potential. Being able to readily coat all silicon nitride surfaces—visible and otherwise—with gold allows silicon nitride surface properties to be tuned through standard gold-thiol chemistry.

Engineering of the process design was optimized to adjust the evenness of the gold coating and control over grain size and deposition rate in the process. Process factors that were optimized include one or more factors, which include, but are not limited to, temperature, pH, concentration, additives such as surfactants, and plating solution composition of the electroless plating solution.

In an embodiment, gold was electrolessly plated along the walls of a through-hole or void in silicon nitride. In yet another embodiment, gold film thickness was controlled by one or a combination of the time the silicon nitride material is kept in the gold plating solution, the temperature of the gold plating solution, possibly the concentration of gold in the gold plating solution, or combinations thereof. In still another embodiment, the gold film quality was controlled by one or a combination of; the time the silicon nitride material is kept in the gold plating solution, the temperature of the gold plating solution, the concentration of gold in the gold plating solution, or combinations thereof.

The chemical processes are described herein, and may also be extended for the electroless plating of other materials. The procedure may also be adapted to create gold-coated silicon nitride nanoparticles for biomedical applications such as diagnostics and drug delivery.

Example 1, Step 1. Cleaning Step for Electroless Plating of Gold onto Silicon Nitride The initial step of the procedure is the cleaning of the silicon nitride substrate and removal of surface oxide layer. Silicon nitride ($SiN_x$) typically has a thin coating of silicon oxide a few nanometers thick over its surface, due to reactions with oxygen in the air. This coating of $SiO_y$ must be removed in order to electrolessly plate the surface. This can be accomplished by first cleaning the surface with acetone, and then plasma-cleaning first with air (50 W for 10 minutes were our chosen settings; may vary according to the individual plasma cleaner used), and then with oxygen plasma (50 W for 5 minutes). The silicon nitride can then be placed under an inert gas such as nitrogen or argon. The oxide layer is then etched away with a 10 minute soak in 2.5% hydrofluoric acid (HF). The solvent and rinse chemicals and concentrations thereof may be varied in various embodiments.

Example 1, Step 1—Addition 1: Surface Treatment for Spatially Patterned Electroless Plating To prepare a spatially patterned substrate surface for Example 1, Step 2—Variation 2 below, the cleaned substrate was irradiated at 254 nm through a patterned mask while in intimate contact with a 1-alkene (or 1-alkyne). After the photoattachment of this patterned molecular layer, rinses with dichloromethane, isopropanol, 1M HCl, and isopropanol were performed.

Example 1, Step 2—Variation 1. Sensitization of Silicon Nitride Surface for Eventual Plating of the Entire Treated Surface The second step in this process is the sensitization of the silicon nitride surface. In this case, the procedure begins with a 45 minute soak in a solution of 0.025M $SnCl_2.2H_2O$ and 0.07M $CF_3COOH$ in a solvent of 50% methanol, 50% ultrapure water. This is followed by one or more rinses in methanol. The substrate is then treated with 0.03M ammoniacal silver nitrate, oxidizing $Sn^{2+}$ to $Sn^{4+}$ and reducing the silver ions to elemental silver. Thorough rinsing in methanol and ultrapure water follow.

Example 1, Step 2—Variation 2. Treatment of Silicon Nitride Surface for Spatially Selective Plating of the Entire Treated Surface This process step begins with soaking the substrate in a hydrochloric acid solution followed by soaking in a solution consisting of $5.6\times10^{-4}$M $PdCl_2$, $1.25\times10^{-2}$M polyethylene glycol (PEG) (average molecular weight of e.g., 3000), and $4.20\times10^{-3}$M methyl gallate in ultrapure water, as described in the Journal of Electrochemistry (2010) for the sensitization of aluminum. This is followed by further rinsing in 1M hydrochloric acid solution. The substrate is then treated with 0.03M ammoniacal silver nitrate, followed by washes with methanol and ultrapure water.

Example 1, Step 3. Electrolessly Plating of Gold

Following the cleaning and sensitization of the silicon nitride surface, the final step is to electrolessly plate gold onto the surface. This is done by using an electroless plating bath to deposit gold onto the silicon nitride surface. This plating bath consists of $8\times10^{-3}$M sodium gold sulfite ($Na_3Au(SO_3)_2$), 0.127M $Na_2SO_3$, and 0.625M formaldehyde. Adjusting the temperature and plating time is expected to yield different gold grain sizes and final film thicknesses. Sodium gold sulfite was synthesized as known in the art, for example, as disclosed in U.S. Pat. No. 6,126,807. Tin, silver, and plating bath concentrations were also used.

Figure 2A:
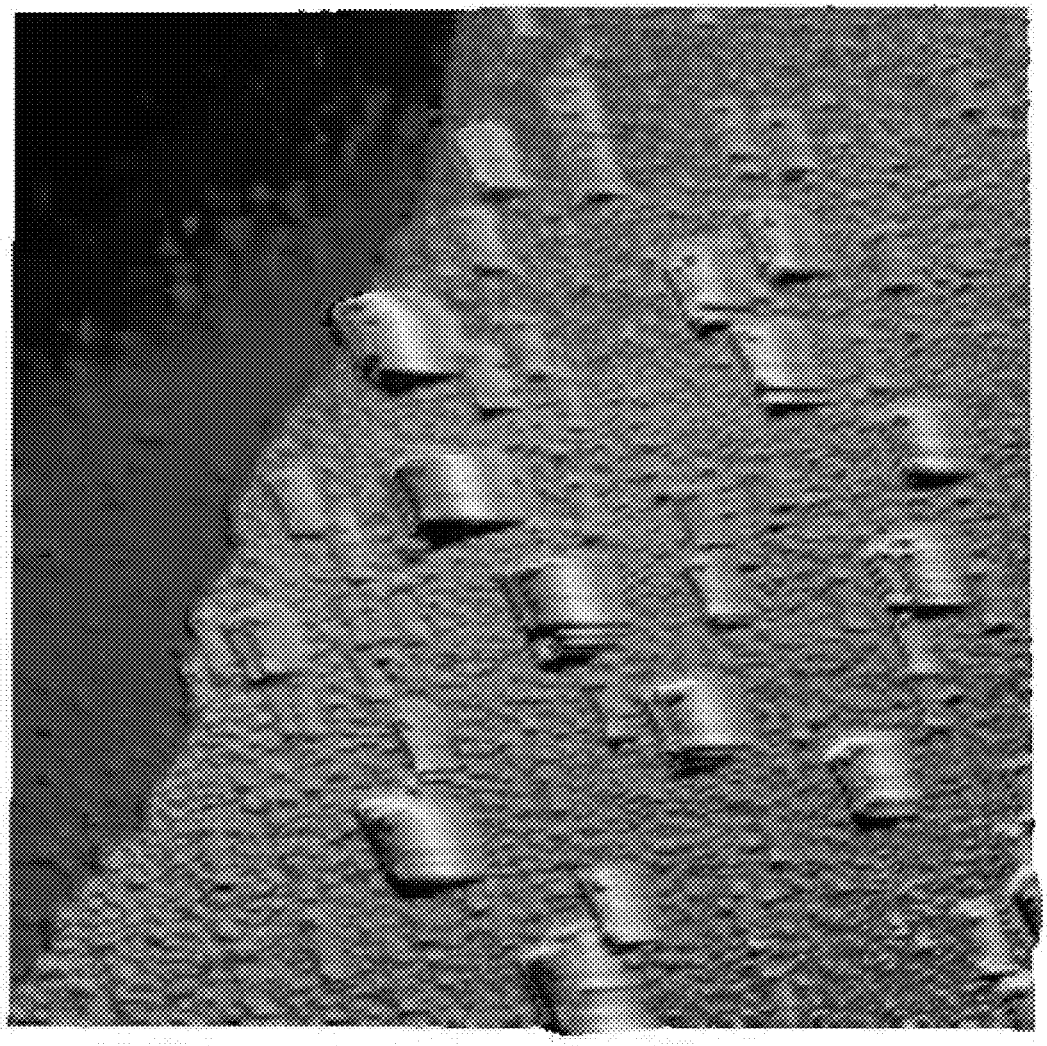
FIGS. 2A-2C show illustrative atomic force microscopy (AFM) scan images of edges between plated gold and bare silicon nitride in accordance with an embodiment of the invention.
Figure 2B:
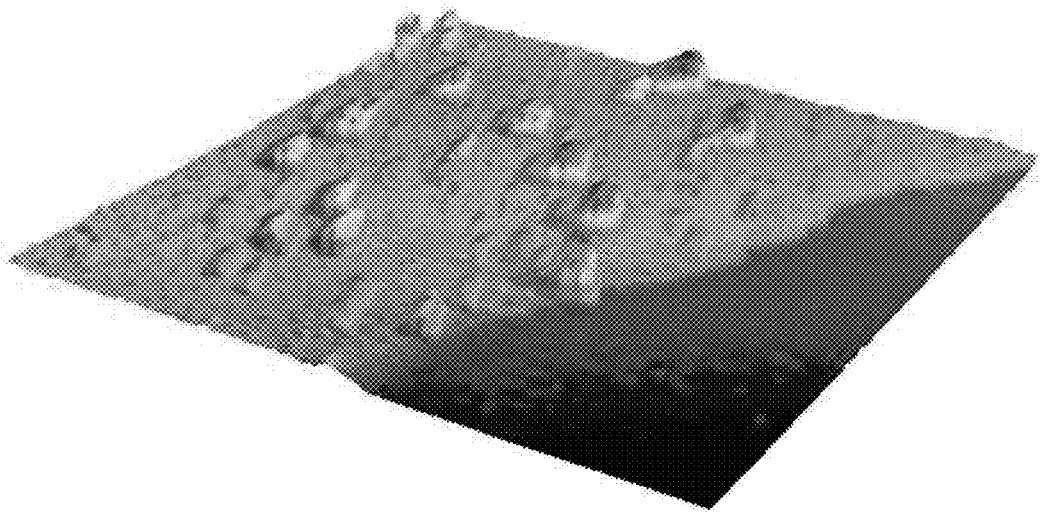
Figure 2C:
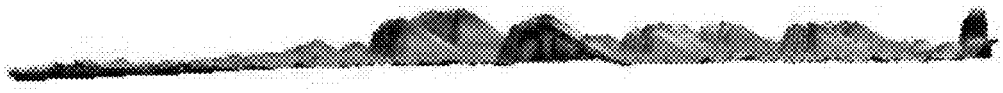
Figure 3A:
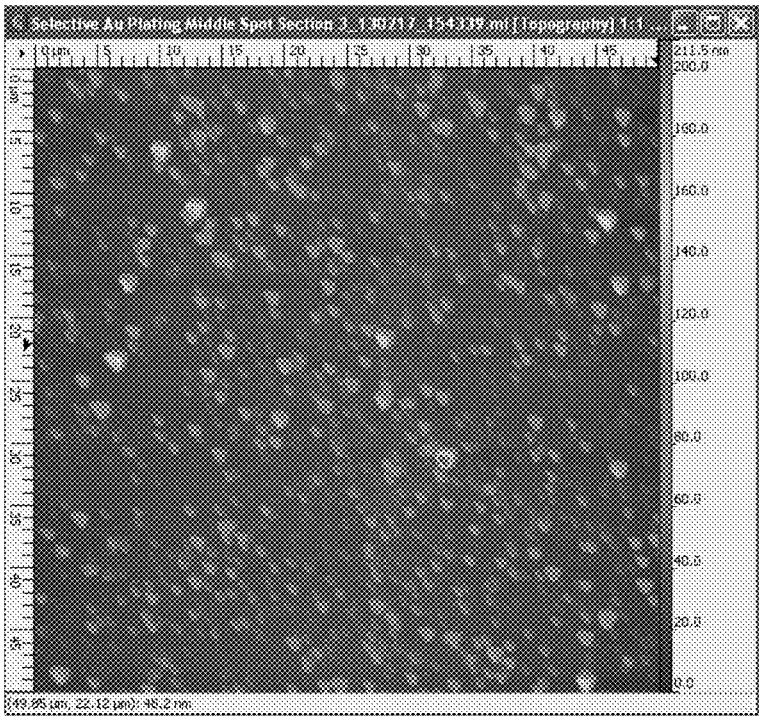
FIGS. 3A and 3B show illustrative AFM scan images of gold plated silicon nitride in accordance with an embodiment of the invention showing grain characteristics.
Figure 3B:
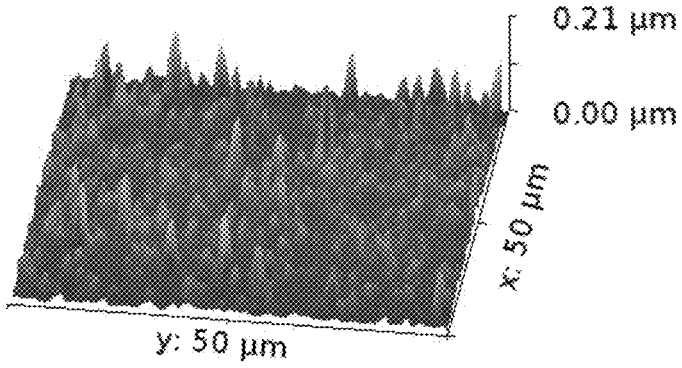
Figure 4:
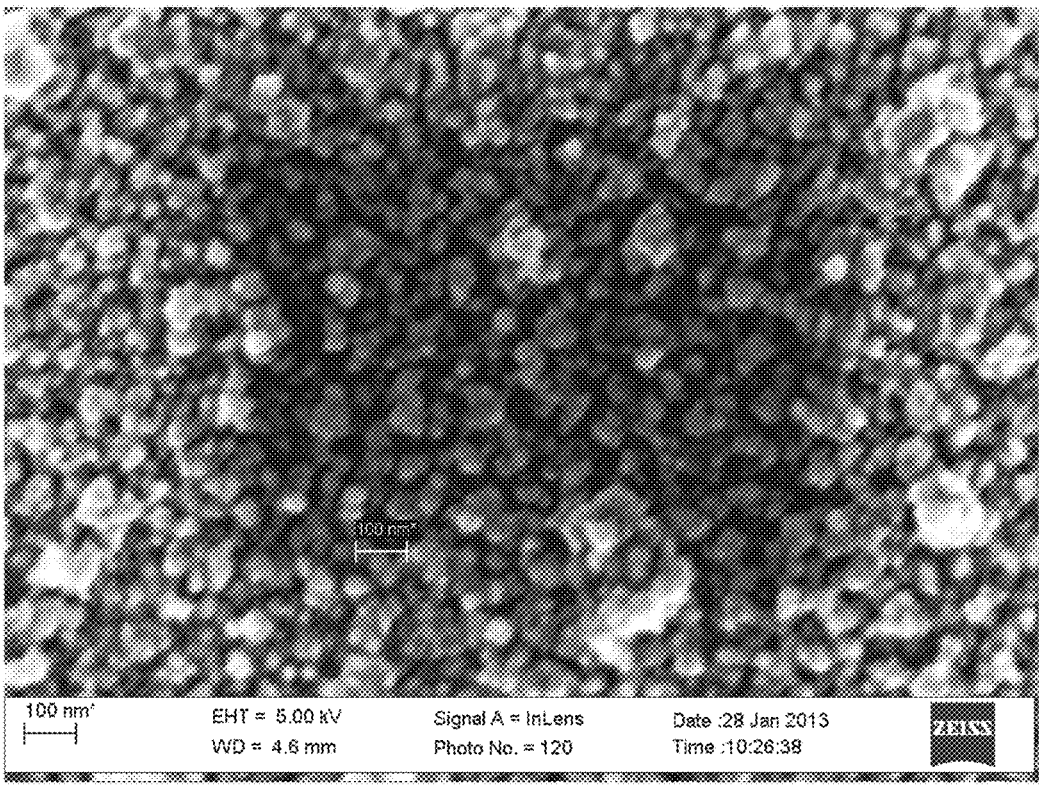
FIG. 4 shows an illustrative scanning electron microscopy (SEM) image of gold film on silicon nitride in accordance with an embodiment of the invention.
Figure 5:
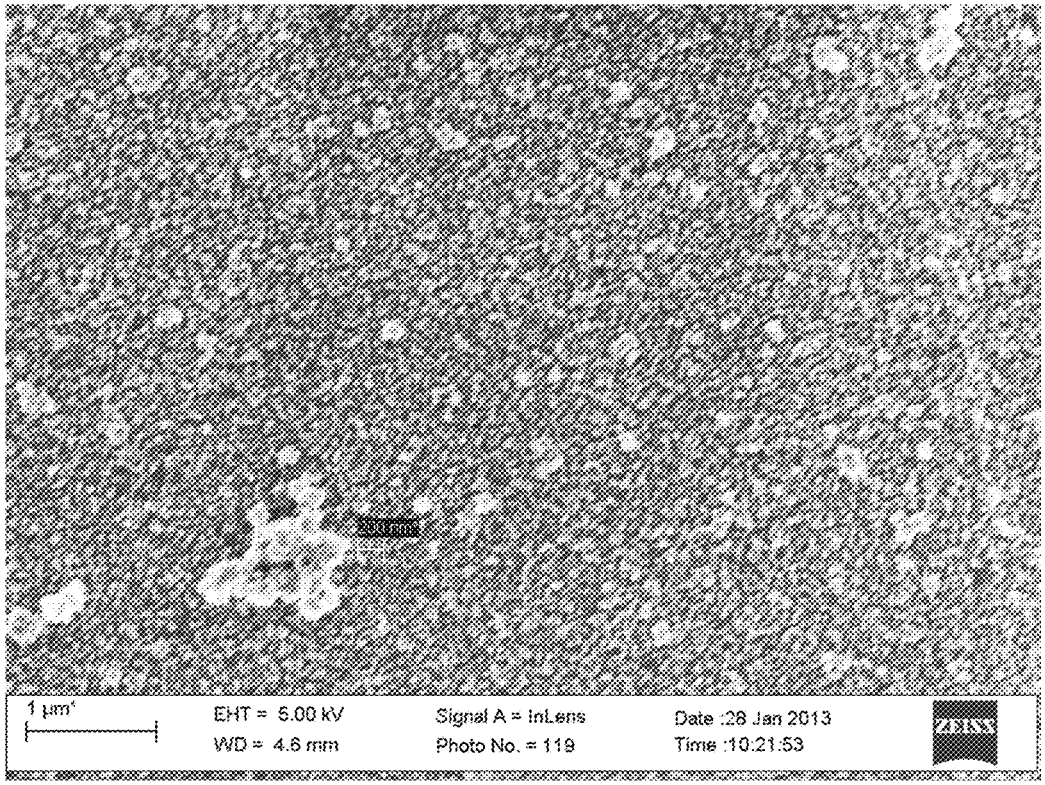
FIG. 5 shows an illustrative field-emission scanning electron microscopy (FE-SEM) image of silicon nitride with gold film in accordance with an embodiment of the invention.

In the top of FIG. 1 is shown at 10 a first disk, untreated silicon nitride. In the bottom panel, is the same silicon nitride wafer after electroless plating resulting in a gold disk as shown at 12. In FIGS. 2A-2C, AFM scans of edge between plated gold and bare silicon nitride, resulting from a 3 hour soak in plating bath at room temperature. AFM scan of gold plated silicon nitride showing grain characteristics is shown in FIGS. 3A and 3B. In FIG. 4, FE-SEM image of gold film on silicon nitride resulting from a 2 hour soak in an electroless plating bath at room temperature. In FIG. 5, FE-SEM image of silicon nitride with gold film resulting from a 2 hour soak in an electroless gold bath at room temperature.

Example 2. Scheme for Electrolessly Plating of Gold Directly onto Silicon Nitride Thin Films The method directly sensitizes the silicon nitride substrate with a $Sn^{2+}$ solution, followed by a series of metal ion treatments in which control was exerted over the gold film thickness using process time and temperature. Film thicknesses (in this example) ranged from 30 to 100 nm for deposition times from 0.5-3 h, and temperatures of 3 and 10° C.

Figure 6A:
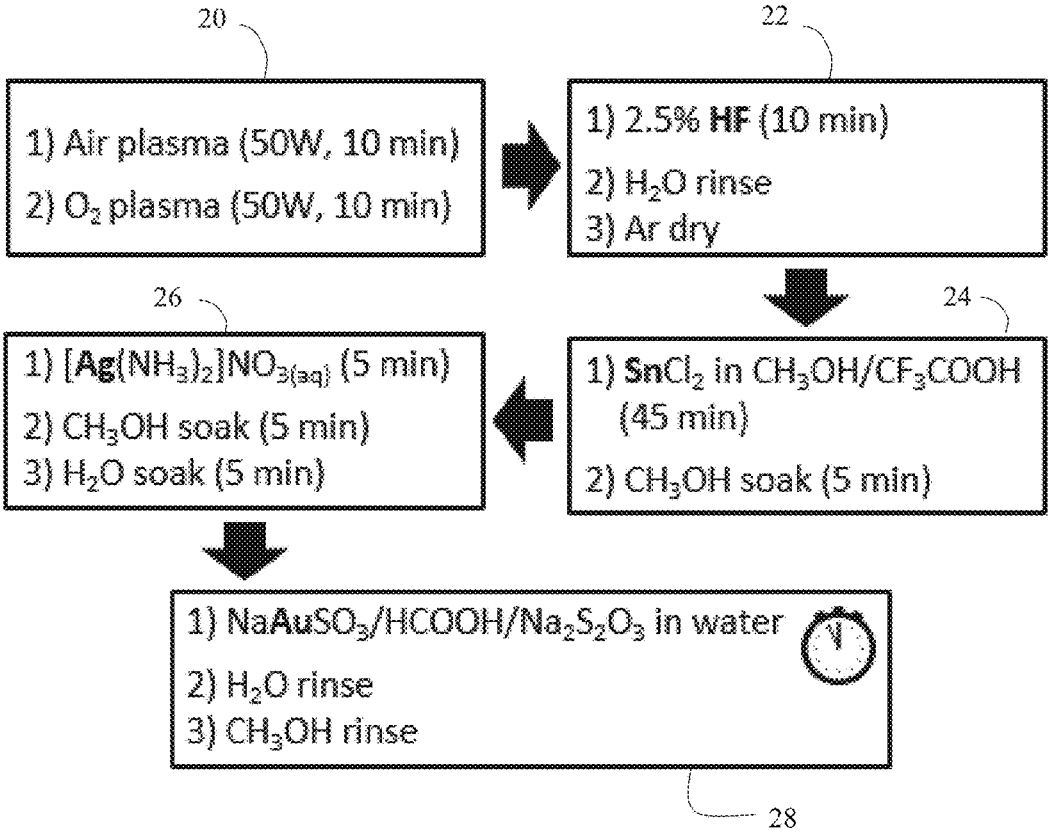
FIGS. 6A and 6B show illustrative diagrammatic views of process steps for the electroless plating (FIG. 6A) and for photopatterned electroless plating (FIG. 6B) in accordance with embodiments of the invention.

As shown in FIG. 6A, in accordance with a method of the invention, the silicon nitride-coated substrates are plasma-cleaned of organics and HF-etched before the surface is exposed to $Sn^{2+}$ ions, which are oxidized during the redox-driven deposition of an elemental silver layer. Gold plating begins with galvanic displacement of the elemental silver.

The substrate, therefore, undergoes an air plasma and an $O_2$ plasma exposure (Step 20), followed by exposure to HF, followed by an $H_2O$ rinse and air dry (Step 22). In various embodiments, the cleaning step may be performed by equivalent chemical treatment such as treatment with piranha solutions, or equivalents such as Nanostrip instead of plasma cleaning. The substrate then undergoes exposure to $SnCl_2$ in $CH_3OH/CF_3COOH$, followed by a bath in $CH_3OH$ (Step 24). The substrate then exposed to $[Ag(NH_3)_2]NO_3$ (aq), followed by a bath in $CH_3OH$, and then $H_2O$ (Step 26). The substrate is then exposed to $NaAuSO_3$/HCOOH/$Na_2S_2O_3$ in water, rinsed in $H_2O$ and then rinsed in $CH_3OH$ (step 28).

Detailed methods for electrolessly plating process were as follows. Each chip was plasma-cleaned prior to use in a Glow Research (Phoenix, Ariz.) Autoglow plasma cleaner with 10 minutes of 50 W air plasma (0.8-1.2 Torr pressure) followed by 5 minutes of 50 W $O_2$ plasma (0.8-1.2 Torr pressure). Each chip was then etched for 10 minutes in 2 mL of a 2.5% aqueous HF solution to remove unwanted silicon oxide from the silicon nitride surface, followed by 3 immersion rinses in water and then drying under an argon stream. The prepared chips were immersed for 45 minutes in 2 mL of a 50/50 methanol/water solution that was 0.025M tin(II) chloride and 0.07M trifluoroacetic acid, followed by a methanol rinse and 5 minute methanol soak, a 5 minute soak in 2 mL of ammoniacal silver nitrate solution, 5 minutes in methanol and finally 5 minutes in water. Electroless gold plating involved submersing the chips in aqueous plating baths comprised of $7.9\times10^{-3}$M sodium gold sulfite, 0.127M sodium sulfite and 0.625M formaldehyde. The chips were plated in 1.5-3 mL of plating solution in small plastic beakers with gentle rocking in a refrigerator (3° C. plating) or thermoelectric cooler (10° C. plating). After plating for the desired time at the desired temperature, the chips were thrice rinsed in alternating methanol and water, and dried in an argon stream (Airgas PP300). For comparison, we additionally sputter-coated (Denton Vacuum Desk II, Moorestown, N.J.) a plasma-cleaned silicon nitride-coated wafer with gold. Further details regarding the preparation of material are may be as disclosed in "Electroless Plating of Thin Gold Films Directly onto Silicon Nitride Thin Films and into Micropores" by Julie Whelan, Buddini Iroshika Karawdeniya, Nuwan Bandara, Brian Velleco, Caitlin Masterson and Jason Dwyer, Applied Materials & Interfaces, American Chemical Society (2014), the disclosure of which is hereby incorporated by reference in its entirety.

An important aspect of the invention is to provide a process sequence for the direct electroless plating of gold onto silicon-rich LPCVD silicon nitride. The sequence includes a pre-cleaning step followed by a series of metal ion treatments, ending in an electroless gold plating step. The important aspect is that the plated film ends up on silicon nitride instead of on an oxide coating on silicon nitride, or with some intervening layer. This is achieved by the standard approach of HF-etching (or equivalent), and the plating is done by a standard set of chemical treatments. A series of (literature-based) tin-, silver- and then gold-containing solutions were used. It should also be possible to make the final film coating something other than gold, simply by drawing on prior art. Silicon-rich LPCVD nitride is also a good candidate substrate for other applications.

Figure 6B:
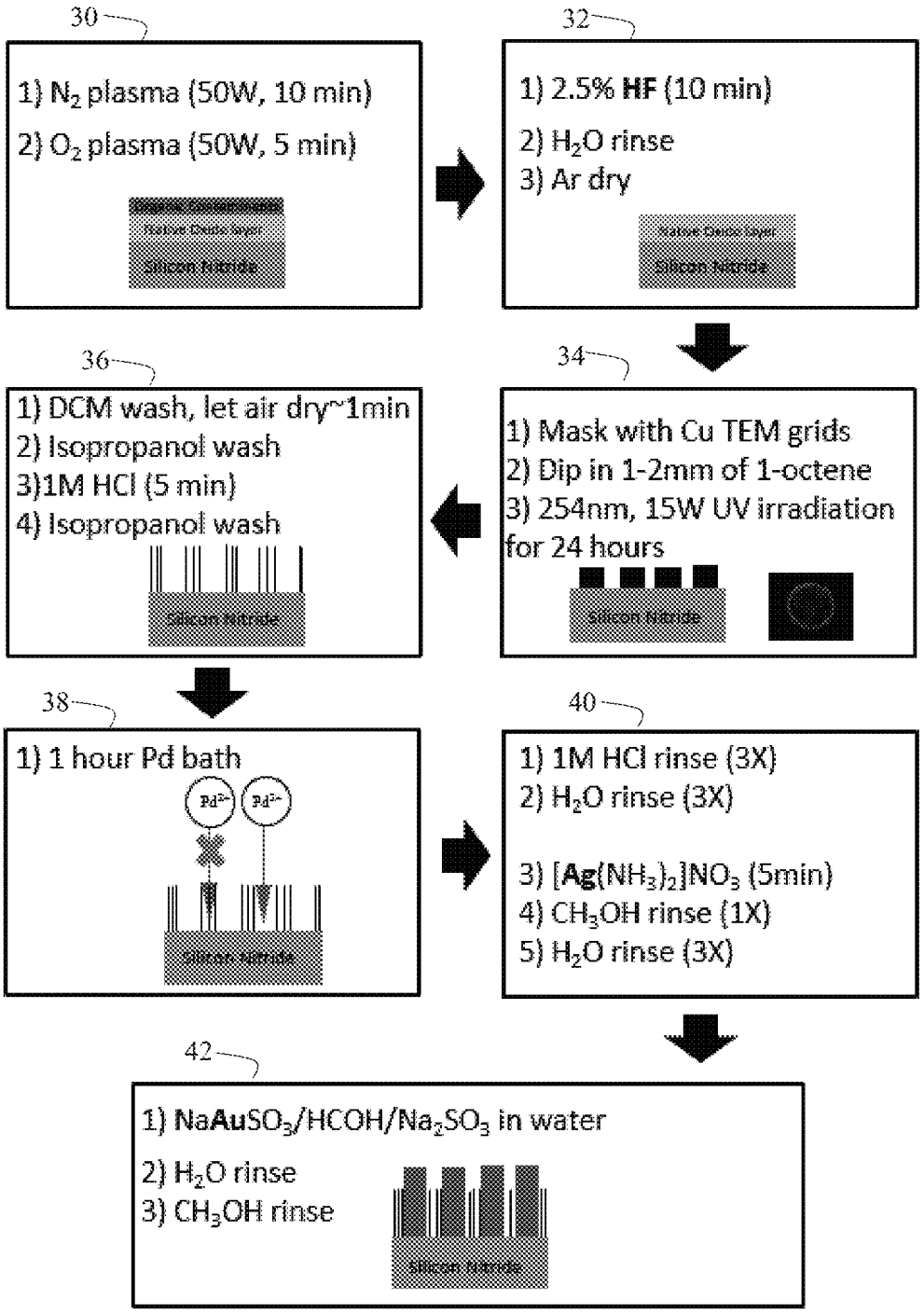

FIG. 6B shows a method in accordance with a further embodiment of the invention for providing a spatially patterned film wherein $N_2$ plasma and $O_2$ plasma are employed (Step 30), followed by a similar HF etch, rinse and dry (Step 32). The substrate is masked with Cu TEM grids, dipped in 1-2 mm bath of 1-octene, then irradiated with UV radiation for 24 hours (Step 34). The substrate is then DCM washed, dried, washed with isopropanol, rinsed with HCl, and then again washed with isopropanol (Step 36). The substrate then undergoes a 1 hour Palladium(II) bath (Step 38), followed by an HCl rinse, an $H_2O$ rinse, an $Ag(NH_3)_2NO_3$ bath, then $CH_3OH$ rinse and then $H_2O$ rinse (Step 40). The substrate is then exposed to $NaAuSO_3$/HCOH/$Na_2SO_3$ in water, and $H_2O$ rinse, and a $CH_3OH$ rinse (Step 42). The addition of 1-octene and 254 nm light in the process of FIG. 6B is a different novel component than simply electroless plating, as it is what allows spatially patterning in the electroless plating process. In other embodiments of the process of FIG. 6B, the process may be run from $Pd^{2+}$ to $Ag^+$ to $Au^+$, or one may skip the $Pd^{2+}$ and go directly from $Ag^+$ to $Au^+$. In various embodiments therefore, the invention provides that a surface may be patterned with an organic overlayer by using a spatially selective hydrosilylation reaction.

The exposed silicon-rich LPCVD nitride surface allows us to photochemically attach 1-alkene (and 1-alkyne)-terminated overlayers. By using a physical mask to control the surface's exposure to light, we are able to covalently link the overlayer to the silicon nitride with control over the spatial distribution of that film. This layer then serves as a mask to control the spatial extent of the electroless gold deposition outlined in Example 1, Step 3 above. Substrates of embodiments of the invention therefore provide the use of masking layers covalently linked directly to silicon nitride, permitting spatially-controlled electroless plating directly onto a silicon nitride surface.

In this patterned implementation, the metal plating ends up on the silicon nitride surface where there is no masking overlayer. It should be possible to: (a) select the masking layer surface chemistry and/or the plating chemistry to preferentially electrolessly deposit metal films ON the masking layer, leaving the silicon nitride layer bare; (b) mask the silicon nitride surface first with one masking layer, then covalently link another layer into the exposed regions so that you have two different types of layers on the silicon nitride surface—you could then preferentially electrolessly coat one of the masking layers instead of the other. All techniques extend readily to silicon. The covalent linking of the masking layer to the surface can also be done using heat. Additionally, by careful choice of the masking layer chemistry, we can subsequently chemically functionalize it to serve other purposes such as attaching additional elements to it. We can also change the gold layer surface chemistry by forming gold-thiol self-assembled monolayers on it.

The use of a spatially-selective process of gold coating (which includes spatially unselective coating as a special case) allows for the following opportunities: 1) the making of surface-bound wires, 2) the making of local areas where the gold film can be overcoated with a gold-thiol self-assembled monolayer (or, more generally, whatever you choose as your final metal coating can be somehow chemically functionalized), 3) if one selectively coats the inside of a nanopore one may then position a species such as an antibody or enzyme at that position inside the pore, 4) one may create gold-bounded corrals with masked silicon nitride bottoms—can, for instance, control hydrophilicity and hydrophobicity of these areas relative to the bare gold or self-assembled-monolayer-coated gold, and 5) one can create Surface-enhanced-Raman spectroscopy (SERS)-active areas on planar substrates and possibly in pores, to permit multimodal nanopore sensing.

Ultrasonic cleaning of the substrate was strictly avoided so that straightforward extension of the scheme to ultrathin silicon nitride windows would not cause window fracture. Each chip was plasma-cleaned and then briefly etched in a dilute hydrofluoric acid (HF) solution to remove unwanted native silicon oxide and expose the silicon nitride surface.

After plating for the desired time at the desired temperature, the chips were carefully rinsed, dried, and then characterized. Gold film thicknesses were obtained by atomic force microscopy (AFM) measurements across an edge from the film to the substrate. Film morphology was examined by field-emission scanning electron microscopy (FE-SEM) and analyzed using a watershed analysis. Elemental analysis of the gold film was carried out by energy-dispersive X-ray spectroscopy (EDS) and by X-ray photoelectron spectroscopy (XPS).

Gold film depositions were carried out in triplicate at each temperature and time point, and the 3° C. trial was repeated so that each film thickness was based on deposition and measurements from between 3-6 different silicon nitride chips (allowing for occasional chip breakage). A step edge from gold film to exposed silicon nitride substrate was created by selectively removing gold film with adhesive tape (Scotch® 810 Magic™ tape) or, when film adhesion to the substrate was stronger, with a gentle pass of plastic tweezers across the substrate.

Figure 7A:
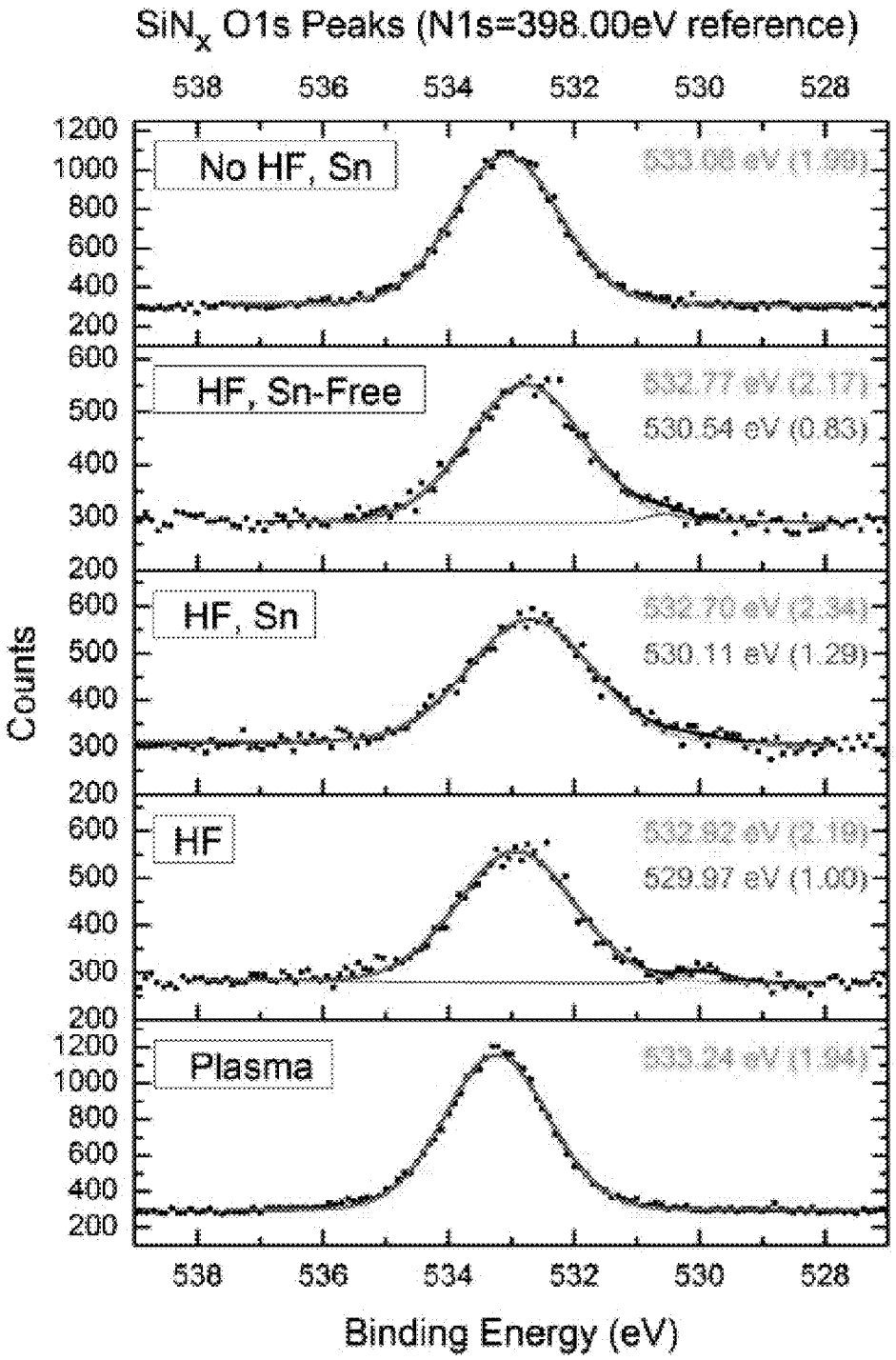
FIGS. 7A and 7B show illustrative X-ray photo-electron spectroscopy (XPS) spectra of $SiN_X$ O1s peaks (FIG. 7A) and Si O1s peaks (FIG. 7B) after the noted treatment steps in accordance with embodiments of the invention.
Figure 7B:
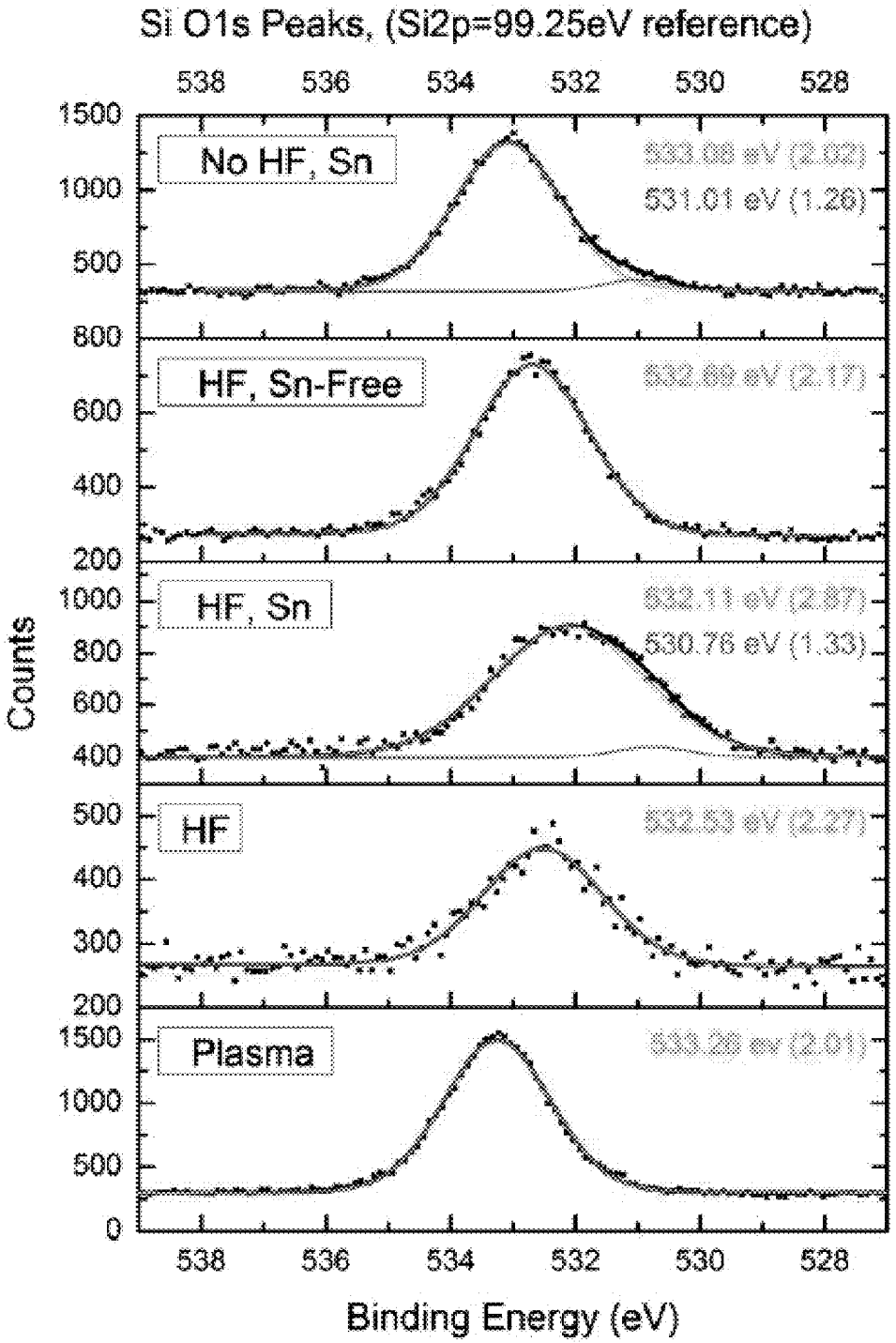

Gold film morphology was examined using a Zeiss Sigma VP FE-SEM at an electron energy of 8 keV (Oberkochen, Germany), and elemental analysis by EDS was performed on the same instrument equipped with an Oxford Instruments X-MaxN 50 $mm^2$ silicon drift detector (Concord Mass.). Custom code was written in Mathematica 9 (Wolfram Research, Champaign, Ill.) to yield gold film grain size estimates via watershed analysis. X-ray photoelectron spectroscopy was used for the majority of the elemental analysis. XPS spectra were acquired using a PHI 5500 system (Physical Electronics, Inc., Chanhassen, Minn.) using unmonochromatized Al Kα radiation (1486.6 eV) and an aperture size of 600×600 $\mu m^2$. Survey scans were performed with 0.8 eV step sizes and 20 ms per step, with a pass energy of 187.85 eV and 10 scans per spectrum. High resolution spectra were recorded with 50 scans per spectrum, 0.1 eV step sizes, 40 ms per step and a pass energy of 23.50 eV. Spectra were analyzed initially with Multipak 6.1 (Physical Electronics). FIG. 7A shows X-ray photo-electron spectroscopy (XPS) images of $SiN_X$ O1s peaks (N1s=398.00 eV reference) and FIG. 7B shows Si O1s peaks (Si2p=99.25 eV reference) after the noted treatment steps in accordance with embodiments of the invention.

Figure 8A:
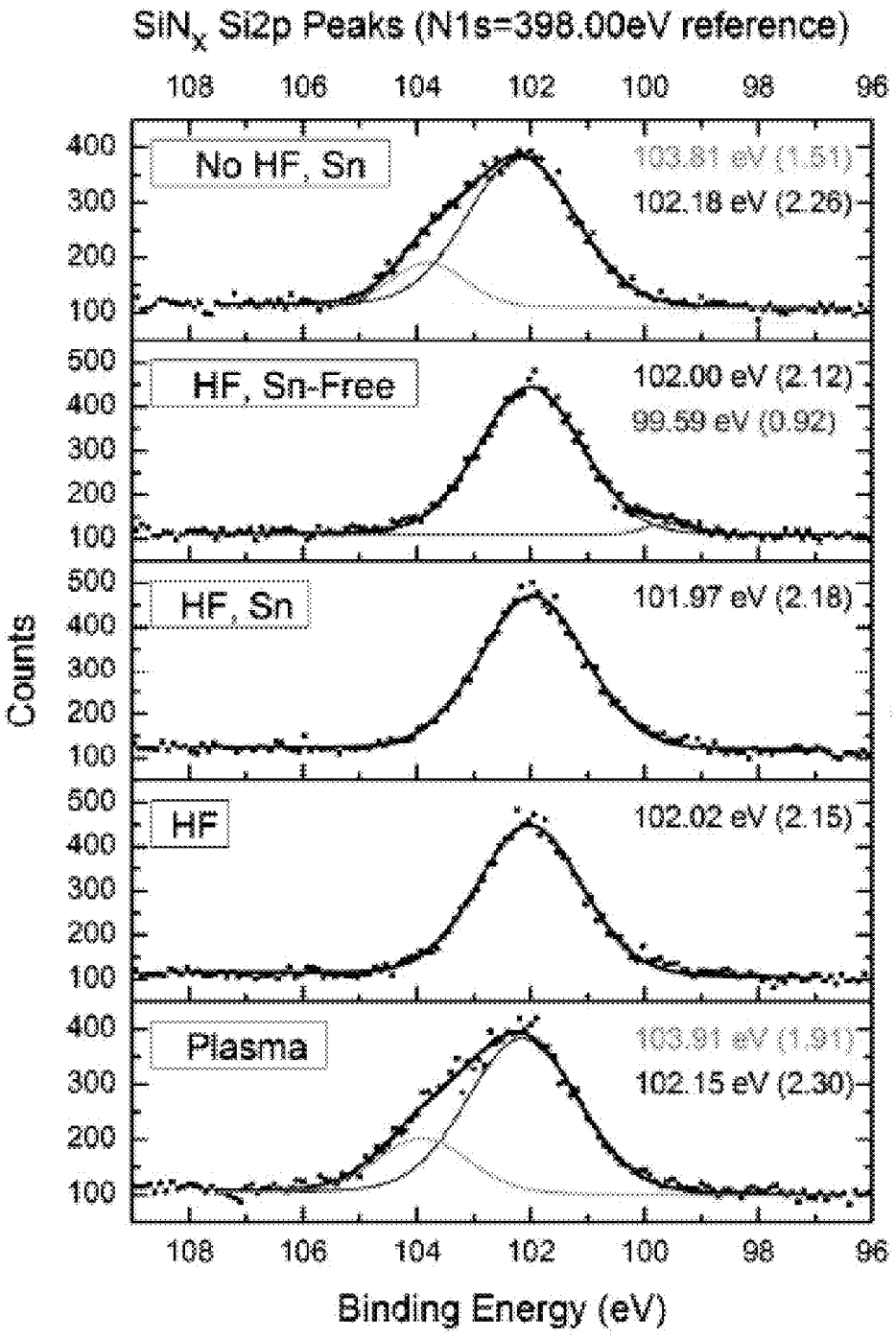
FIGS. 8A and 8B show illustrative XPS images of $SiN_X$ Si2p peaks (FIG. 8A) and Si Si2p peaks (FIG. 8B) after the noted treatment steps in accordance with embodiments of the invention.
Figure 8B:
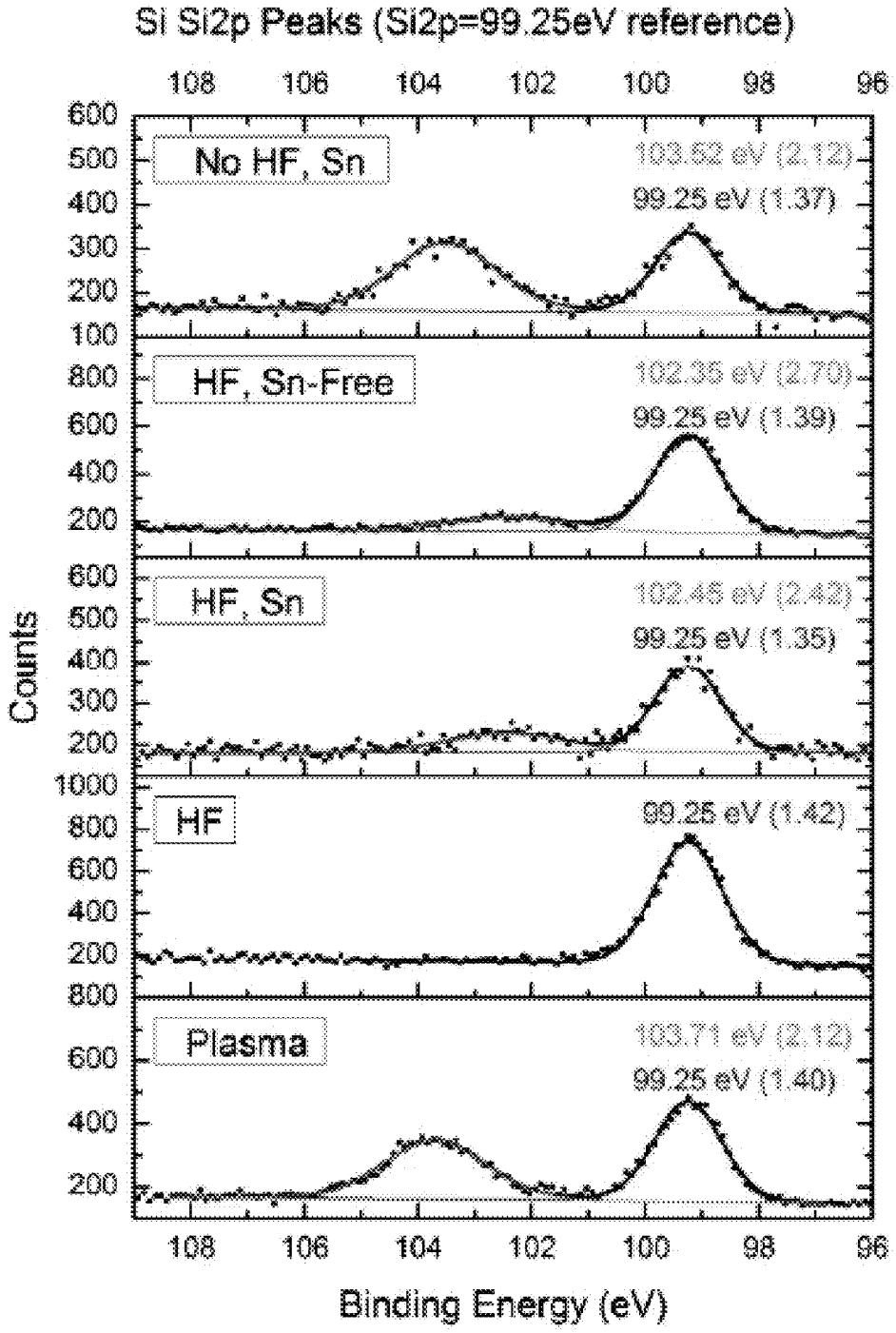

FIG. 8A shows XPS images of $SiN_X$ Si2p peaks (N1s=398.00 eV reference) and FIG. 8B shows Si Si2p peaks (Si2p=99.25 eV reference) after the noted treatment steps in accordance with embodiments of the invention.

Figure 9A:
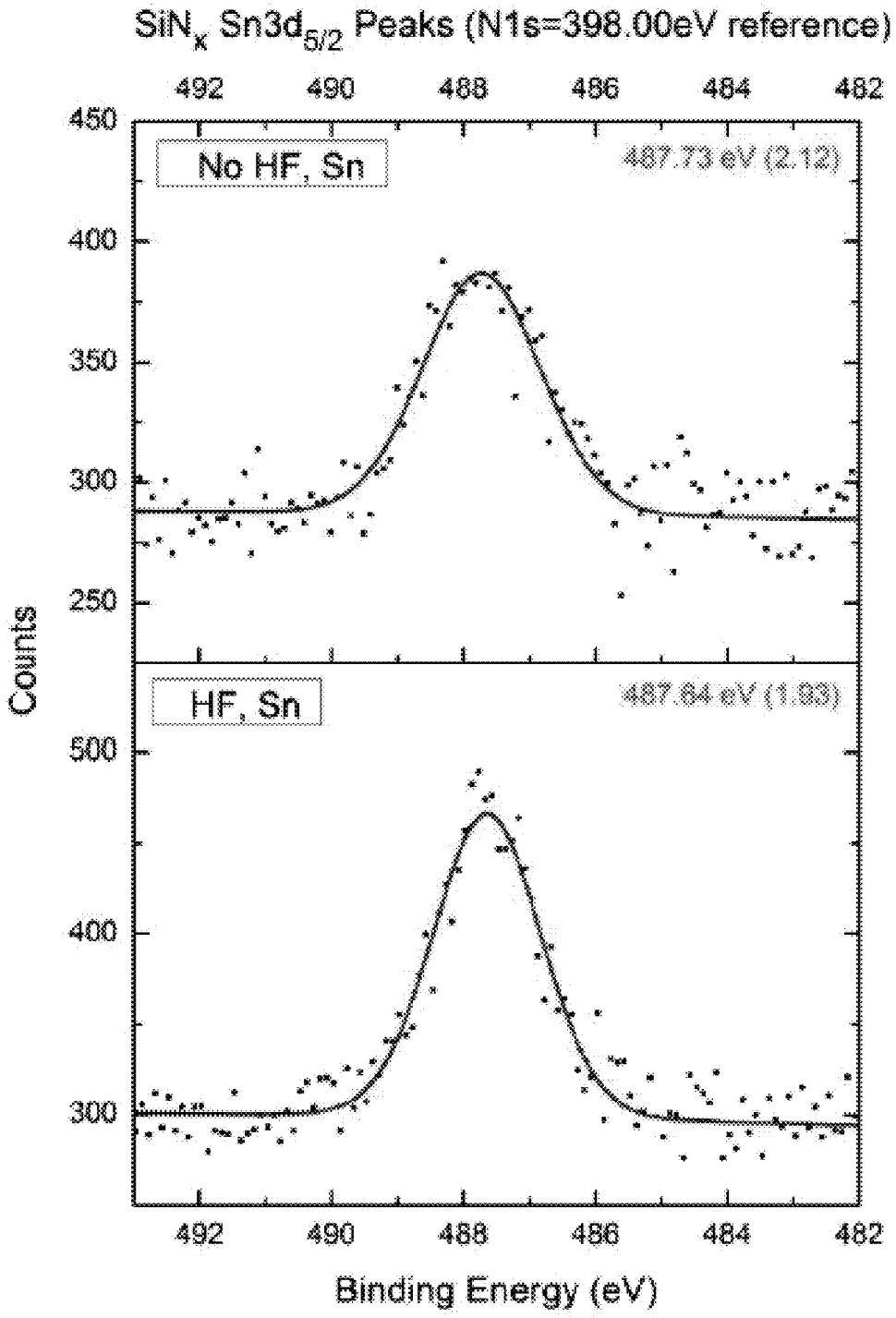
FIGS. 9A and 9B show illustrative XPS images of $SiN_X$ $Sn3d_{5/2}$ peaks (FIG. 9A) and Si $Sn3d_{5/2}$ peaks (FIG. 9B) after the noted treatment steps in accordance with embodiments of the invention.
Figure 9B:
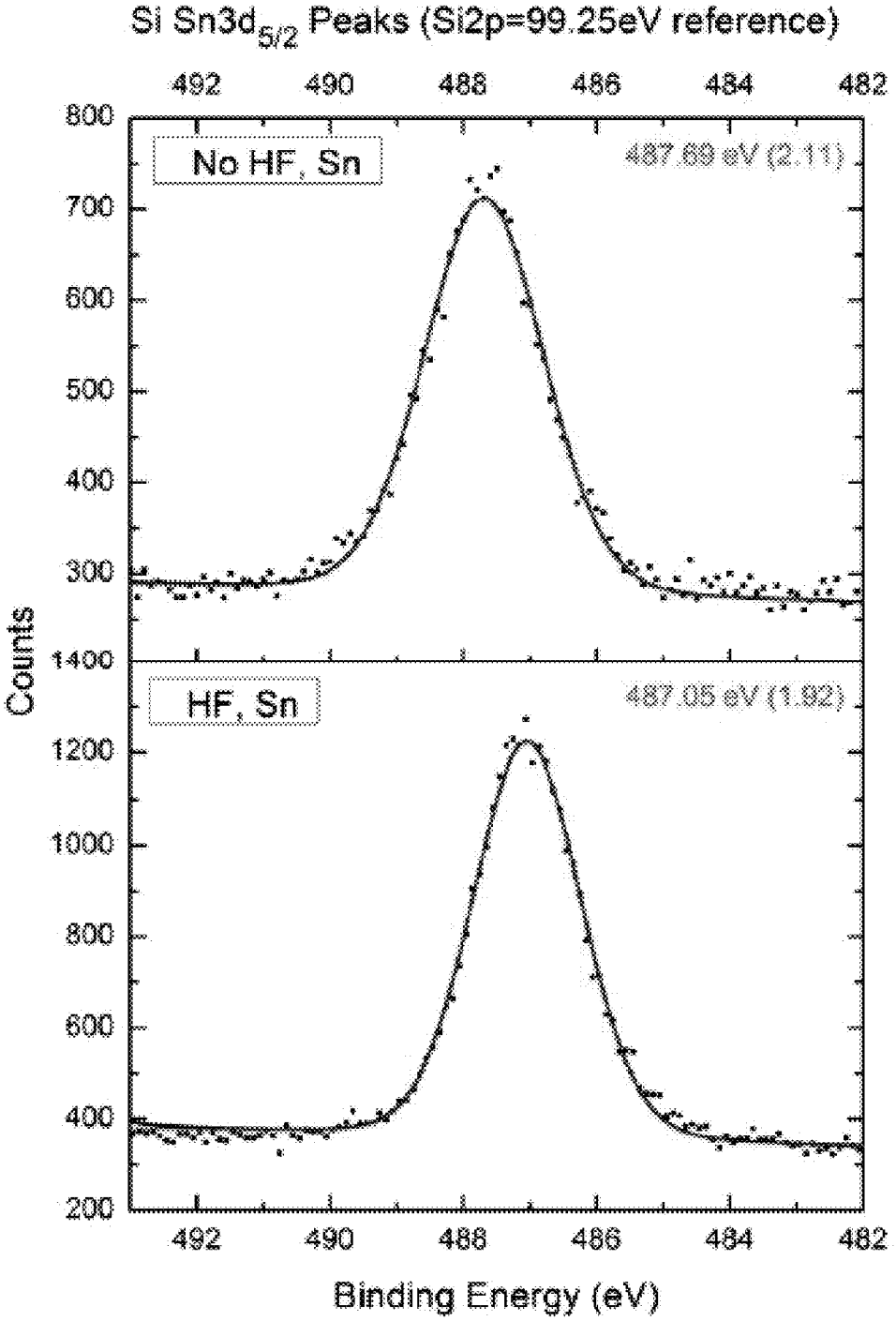

FIG. 9A shows XPS images of $SiN_X$ $Sn3d_{5/2}$ peaks (N1s=398.00 eV reference) and FIG. 9B shows Si $Sn3d_{5/2}$ peaks (Si2p=99.25 eV reference) after the noted treatment steps in accordance with embodiments of the invention;

Adherence to the Scheme of FIG. 6A produced gold films, evaluated by visual inspection, with good quality and excellent macroscopic surface coverage, and delivered these results reliably over many months of repeated trials. More detailed characterization of these films is provided below. Departures from the scheme, however, yielded generally poor or inconsistent results. Attention was focused on varying the surface preparation steps, specifically testing surface preparations that did not involve HF etching designed to remove the oxygen-containing overlayer. Tin(II) sensitization after sodium hydroxide surface roughening had been reported on silicon nitride powders of unknown stoichiometry.

Indeed, surface roughening to improve film adhesion is a familiar preliminary process in electroless plating. Substituting 1, 4.5, or 9 M NaOH treatments for the HF etching of the Scheme, however, generated only gold smudges after 3 h of plating at 3° C. The silicon-rich nature of our LPCVD films is a possible contributing factor to the poor plating quality after NaOH treatment in comparison to the published results, given the general challenge that silicon nitride stoichiometry and available surface species—and thus functionalization opportunities—depend on the details of the silicon nitride synthesis.

The use of large-area, planar substrates introduces another likely explanation: it provides a stringent test of film deposition quality, and easily reveals defects that may be more difficult to discern on a film coating a powder. Traditional silicon nitride surface modification schemes rely frequently on modification of a silica layer on the silicon nitride surface rather than of the silicon nitride, itself. Careful attention to the quality of the oxygen-containing surface layer can circumvent difficulties that stem from a lack of definition of this silica layer. Others have used nitric acid to enrich the number of surface hydroxyl groups on silicon nitride so that they could use silane chemistry to provide an organic monolayer foundation for an overlying electrolessly deposited gold film.

While successful, the approach must contend with the acknowledged challenges of silane chemistry and with the persistence of the organic linker layer. Given the affinity of $Sn^{2+}$ for such an oxygen-enriched silicon nitride surface, and given prior demonstrations of electroless gold plating on silica surfaces, the HF etch in Scheme 1 was replaced with a 20 min treatment in 10% (v/v) nitric acid at 80° C. The results, shown in FIGS. 10 A-10C, were promising, with repeated, although not consistent, deposition of (visually inspected) highquality gold films.

Figure 10A:
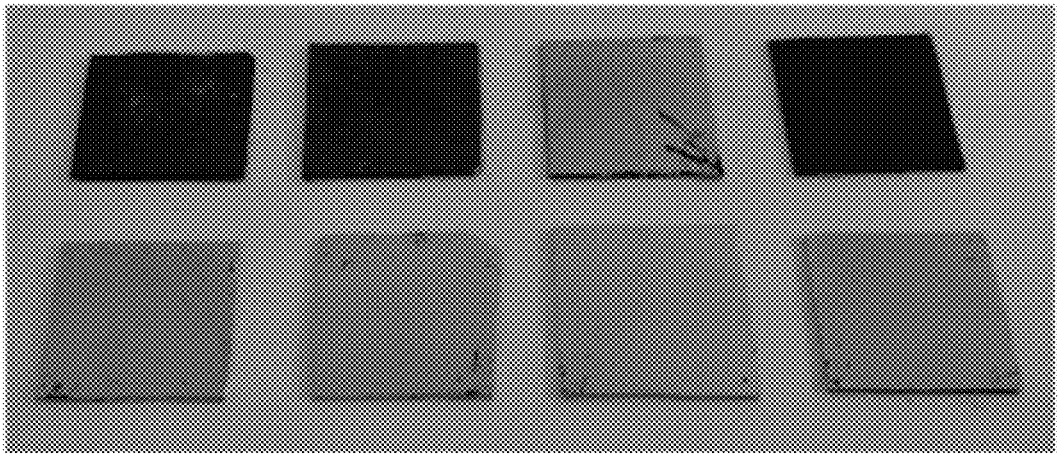
FIGS. 10A-10C show illustrative photographic images of silicon nitride plated with thin gold film in accordance with embodiments of the invention (FIGS. 10A and 10B) and AFM measurements showing film-substrate step height per electroless deposition time (FIG. 10C)
Figure 10B:
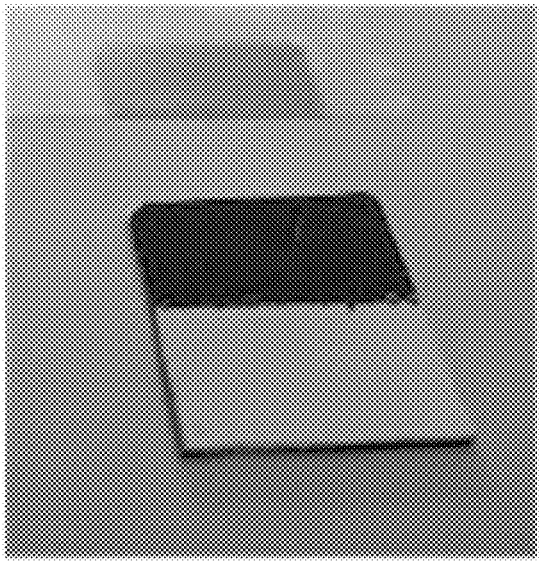
Figure 10C:
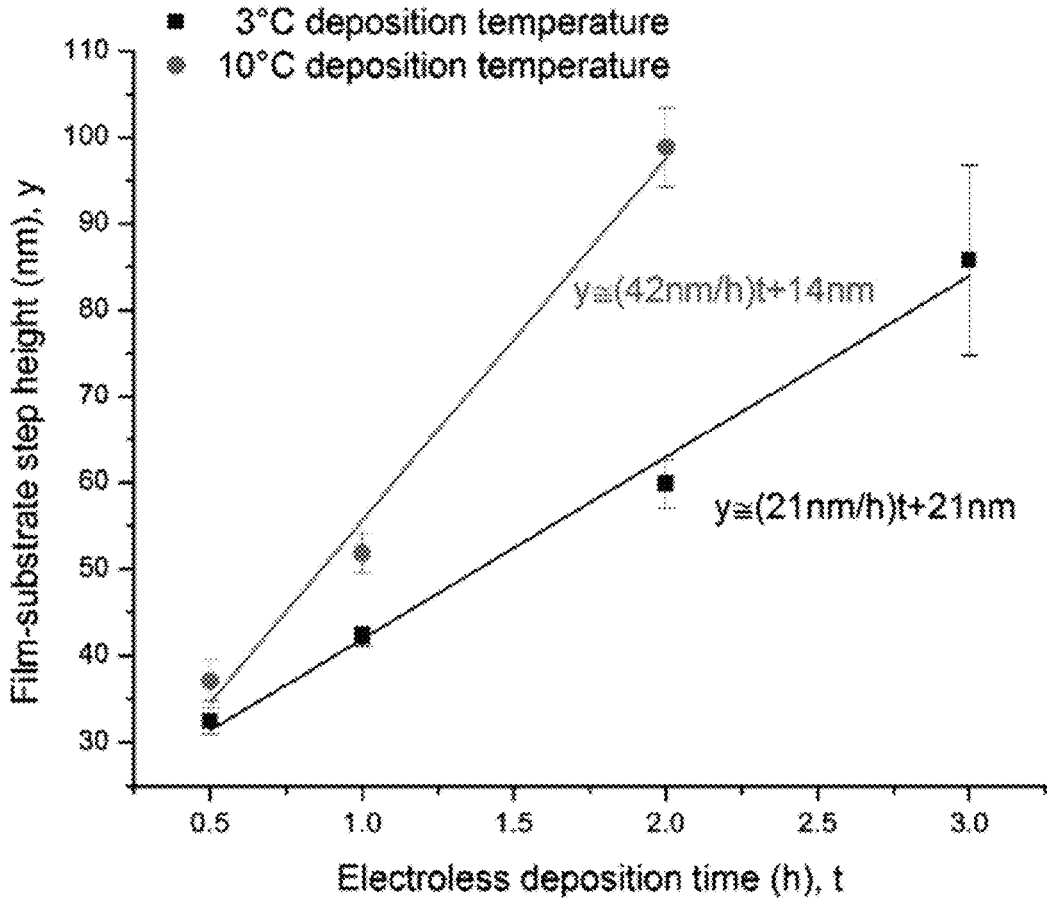

FIG. 10A shows a photograph array of plating results at 3° C. Top row, left-to-right: HF etch omitted, 1 h plating after $HNO_3$ preparation, $HNO_3$ step replicate, plasma-cleaned only (subsequent steps omitted). Bottom row, left-to-right: Scheme 1 followed for plating times of 30 min, 1, 2, and 3 h. The scratches in the film arose during handling of the chips. FIG. 10B shows that adhesive tape could lift most of the gold film to give an edge for AFM measurements of electroless gold deposition film thickness. FIG. 10C shows such AFM measurements for electroless gold deposition film thickness as a function of time and temperature.

It is likely feasible to optimize this route to routinely deposit high-quality, uniform gold films, but a goal was to develop a simple route to electrolessly plate gold directly onto silicon nitride. Treatment of silicon-rich LPCVD silicon nitride surfaces with dilute hydrofluoric acid eliminates the native oxide and leaves a H-terminated surface with Si—H, NH and $NH_2$ moieties. Given the appeal of this surface for surface functionalizations, its compatibility was tested with tin(II)-based sensitization. The Example 2 thus follows the plasma-based cleaning steps with an HF etch step that removes oxide and H-terminates the surface, and ends with the gold plating treatments. It is noted that in the absence of the HF-etching step, chips would sporadically be coated with patchy gold layers, but no uniform high-quality gold films were observed on these chips even after 3 h in the gold plating solution. The row of visually high-quality, high-coverage gold films shown in FIG. 10A were electrolessly plated at 3° C. for increasing lengths of time, with strict adherence to the process of FIG. 6A.

Figure 13A:
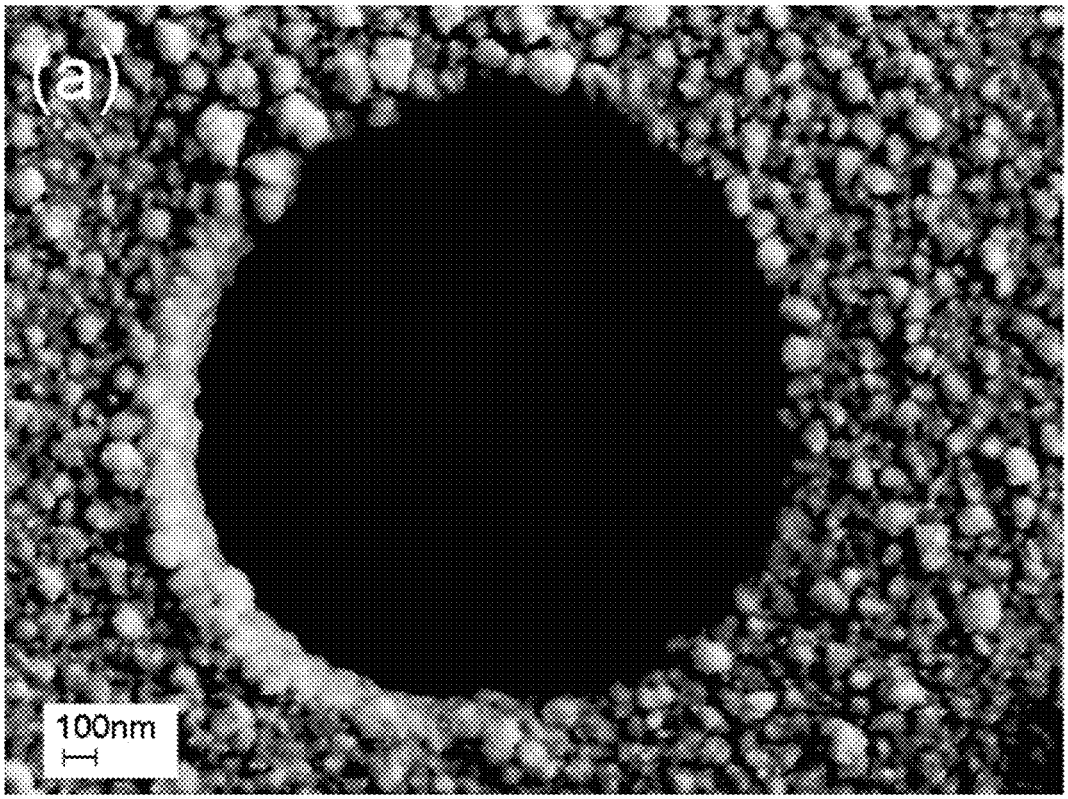
FIGS. 13A-13D show illustrative FE-SEM images of gold coating that can be seen to cover the planar membrane and curved inner pore surface of the free-standing membrane area (FIG. 13A), with its uncoated equivalent (FIG. 13C), as well as a purposefully fractured membrane showing the gold coating on the micropore surface and the silicon nitride membrane (dark line) with intact gold coating (FIG. 13B), and plating on the bottom of a 200 nm deep well where it intersects with the silicon substrate (FIG. 13D)
Figure 13B:
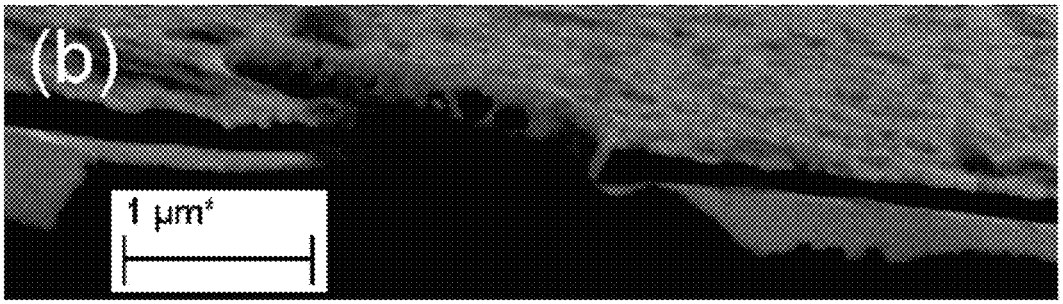

The gold films survived extensive handling including prolonged immersion in liquids interspersed with repeated rinsing and pressurized argon-drying steps, and moreover adhered well to free-standing films that were broken deliberately for imaging (See FIG. 13B). Certainly in applications using gold-coated, freestanding silicon nitride membranes, consideration of membrane robustness will supersede gold adhesion in importance. The films could, however, be scratched with tweezers and mostly removed with adhesive tape (FIG. 10B), and this afforded us the ability to perform AFM film thickness measurements. A swath of the gold film was removed and the mean difference in height between the film and the bare substrate was averaged across several representative line profiles and several independently plated chips for each plating time and temperature.

Figure 11:
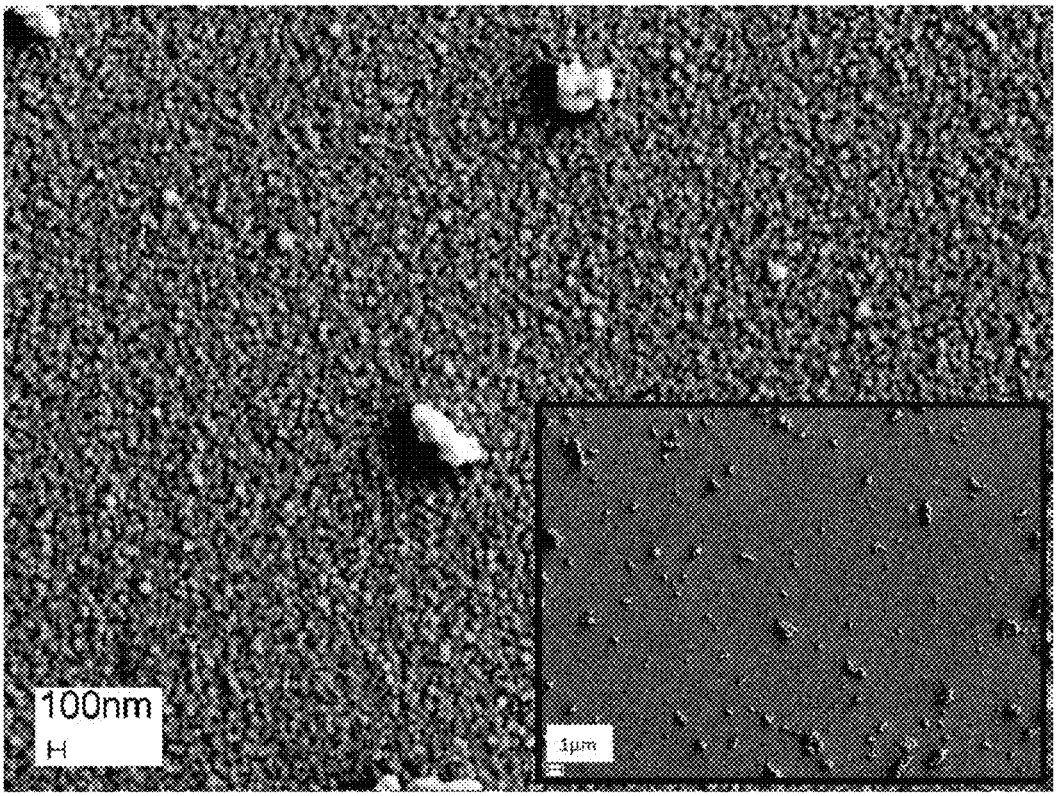
FIG. 11 shows an illustrative SEM image of a film after 2 hours of gold plating at 3° C.

FIG. 10C plots the step height from plated film to bare substrate as a function of time: at 3° C. a step height of ~30 nm after 30 min with a linear fit yielding a ~20 nm/h deposition rate thereafter, and at 10° C. a step height of ~35 nm after 30 min with a linear fit yielding a deposition rate of ~40 nm/h thereafter. The intercept likely arises from residual silver nanoislands scattered across the substrate. Shorter plating times than those shown in FIG. 10C typically produced chips with a purple-blue hue. Four-point film resistivities were measured for the films plated at 3° C. for all the time points listed, and were in the range ~$3\text{-}5\times10^{-6}$ Ωcm; thin film resistivities higher than the known bulk gold resistivity ($2.2\times10^{-6}$ Ωcm) are not surprising. SEM micrographs afford a further detailed view of the film structure (FIG. 11). Microscopic substrate coverage was high, but not complete, after 30 min of plating at 3° C., but was on par, after 30 min at 10° C. and 1 h at 3° C., with the coverage shown in the SEM micrograph shown in FIG. 11. The films were thermally annealed, which results in the film morphology (e.g., grain size) changing. In addition to coating of pore surfaces, coating of silicon nitride nanoparticles is also possible in accordance with further embodiments of the invention.

Spatially patterned gold films can serve as planar electrodes, wires, grids, bounding boxes. Spatially selective gold-plating is a way to achieve spatially-patterned organic monolayers, achieved through gold-thiol chemistry (or, more generally, the covalent 1-alkene/1-alkyne-mediated masking can be used to mask the electroless deposition steps that culminate in a different final metal layer, and thus require different chemical interactions to yield monolayers on top of those different metal layers). These monolayers can be used to attach other species such as antibodies or DNA oligomers for use in biomedical sensing assays. The gold films of embodiments of the invention are already SERS-active, but spatially patterned gold films may have greater SERS enhancement. Electrolessly-gold-plated electrodes can be added to a silicon nitride nanopore, for instance, to create hybrid biomedical device sensors. Spatially selective gold-coating can allow us to tune the size, shape and surface chemistry of nanopores in silicon nitride.

Micrographs for both temperatures and all plating times were subjected to watershed analysis and yielded area-equivalent mean grain radii from 20 to 30 nm. It is clear from the SEM images, however, that the film structure is more complex than can be represented in a single equivalent grain size. There were large agglomerates on the film surface, seen also in AFM line profiles, with radii of several hundred nanometers. EDS analysis of these larger features showed them to be gold. Many of these outcroppings had quite convoluted shapes; there is the potential for quite compelling applications arising from both the regular and irregular film grain structures. Indeed, the films are useful as a platform for surface-enhanced Raman spectroscopy (SERS).

Figure 12:
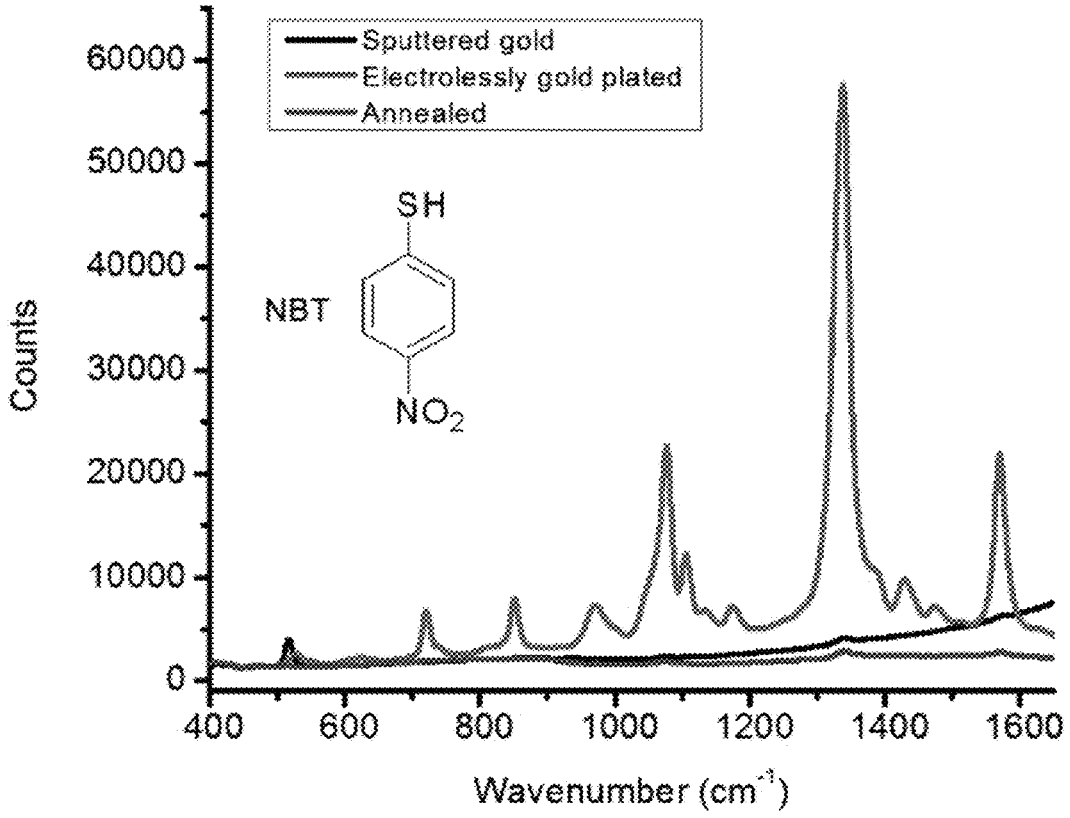
FIG. 12 shows an illustrative graphical representation of measured surface-enhanced Raman spectra from 1 $cm^2$ silicon nitride substrates soaked in 0.01 M NBT for 5 min: from a substrate electrolessly gold-plated at 3° C. for 3 h (electrolessly gold plated), from the same chip plasma cleaned, annealed at 280° C. for 20 min, and plasma cleaned again before NBT exposure (annealed), and from a sputtered (30 s) gold film (sputtered gold)

FIG. 12 shows a demonstration spectrum of 4-nitrothiophenol (NBT) taken from an electrolessly gold-coated silicon nitride substrate. Annealing of these films caused an attendant decrease in the SERS signal, and after annealing for 24 h at 280° C., the mean grain size had increased to nearly 50 nm. Although the electroless gold plating was strongly sensitive to the surface preparation of the silicon nitride, it is noted, for completeness, that the exposed silicon at the edges of the chips was consistently gold-plated, regardless of whether the wafer was treated with HF, $HNO_3$, or NaOH. Polished ~1 $cm^2$ silicon chips treated according to the process of FIG. 6A developed uniform, high-quality gold films across the surface. This result suggests that the silicon-rich nature of our silicon nitride films may contribute to the electroless plating process. Candidate mechanisms for tin-sensitizing silicon nitride thus extend beyond those involving nitrogen-containing surface species. The prospect of definitive elucidation of the mechanism, however, must be weighed in the context of clear precedent in the literature that the complexity of silicon nitride surface chemistry makes it difficult to unravel surface attachment mechanisms. The chemical complexity of the reagents and supporting media involved in electroless plating further compounds the challenges, compared to physical deposition in vacuum or covalent attachment chemistry in solution.

Overall, the XPS spectra suggest complex roles for oxygen and tin in the surface sensitization steps and, while the detailed mechanism of sensitization remains unresolved, adherence to the Scheme exposed the silicon-rich LPCVD silicon nitride surface for direct surface modification and yielded high-quality gold films. In fact, in spite of complex and challenging surface chemistry, the choice of silicon nitride as a substrate opens a panoply of possible applications for consideration, and the use of a solution-based gold plating method allows one to coat surfaces that are difficult or impossible to reach by line-of-sight metal coating methods. Special attention was paid in the development to be able to coat free-standing thin silicon nitride membranes.

As a final demonstration of the capabilities of this method, electrolessly gold plated micropore arrays were fabricated in thin (200 nm) silicon nitride membranes. FIGS. 13A-13D show two representative gold-coated 2 μm micropores, with the first plated into a free-standing portion of the membrane, and the second plated in a region of the silicon nitride pores overlapped with the underlying silicon support frame.

Figure 13C:
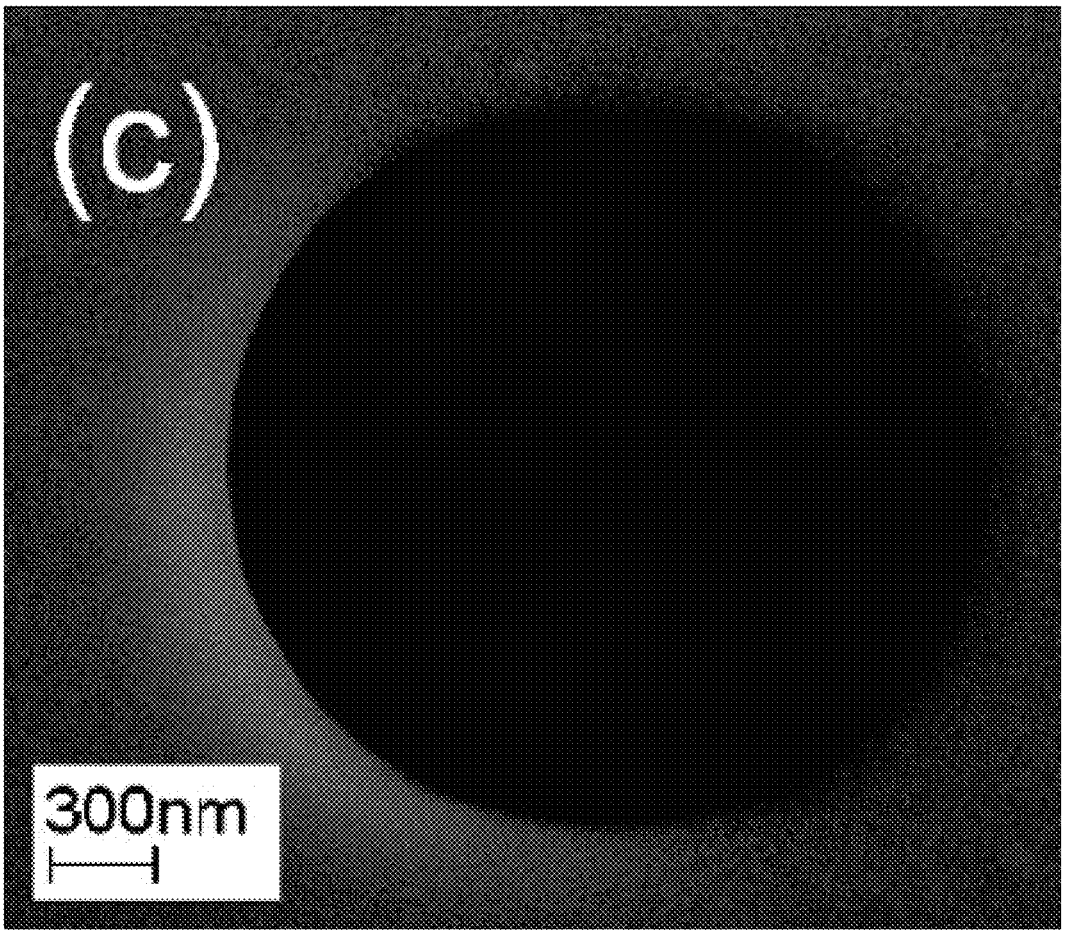
Figure 13D:
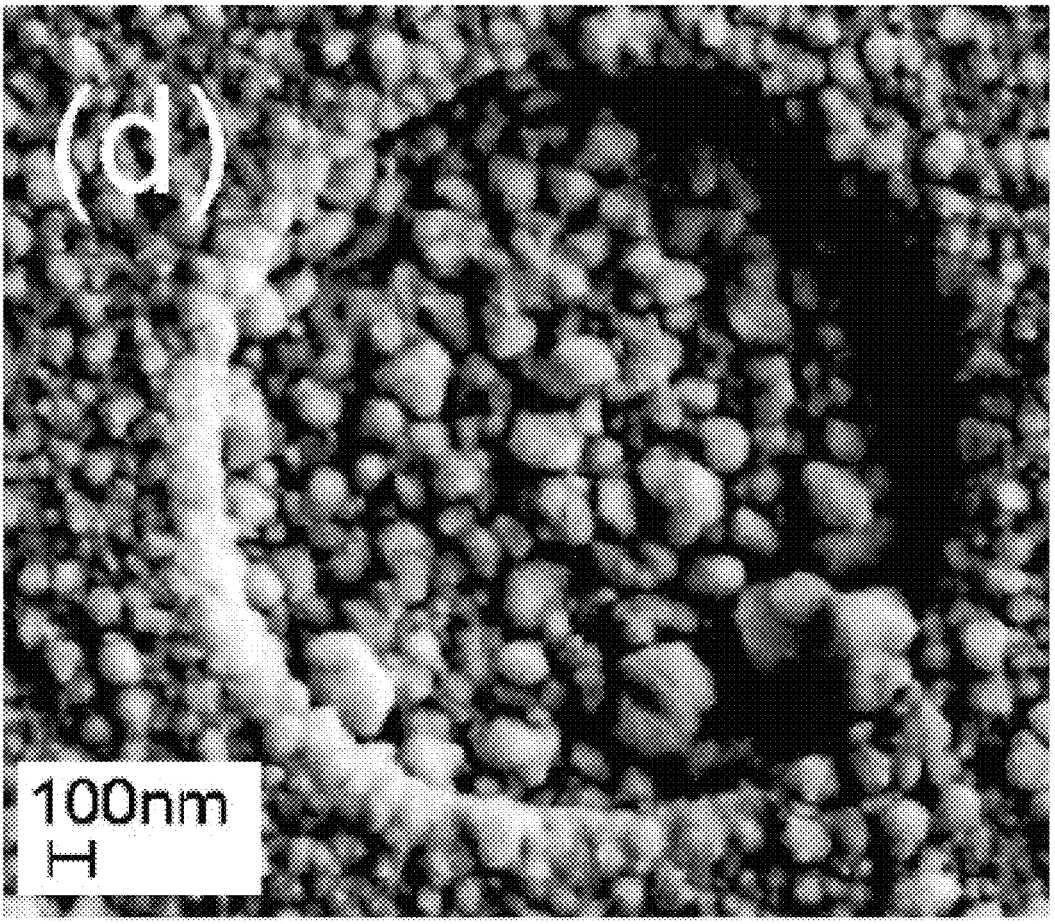

In particular, gold coating can be seen to cover the planar membrane and curved inner pore surface of the free-standing membrane area as shown in FIG. 13A, with FIG. 13C showing its uncoated equivalent. FIG. 13B shows a purposefully fractured membrane showing the gold coating on the micropore surface and the silicon nitride membrane (dark line) with intact gold coating. FIG. 13D shows that plating also occurred on the bottom of the 200 nm deep well where it intersects with the silicon substrate.

Figure 14:
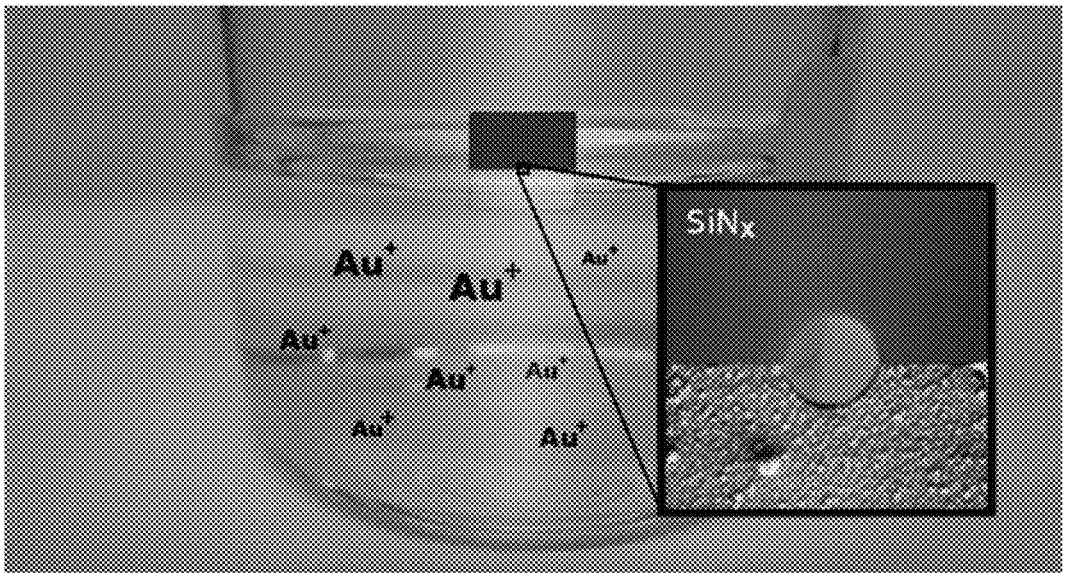
FIG. 14 shows an illustrative representation of silicon nitride with a thin gold film in accordance with an embodiment of the invention.
Figure 15:
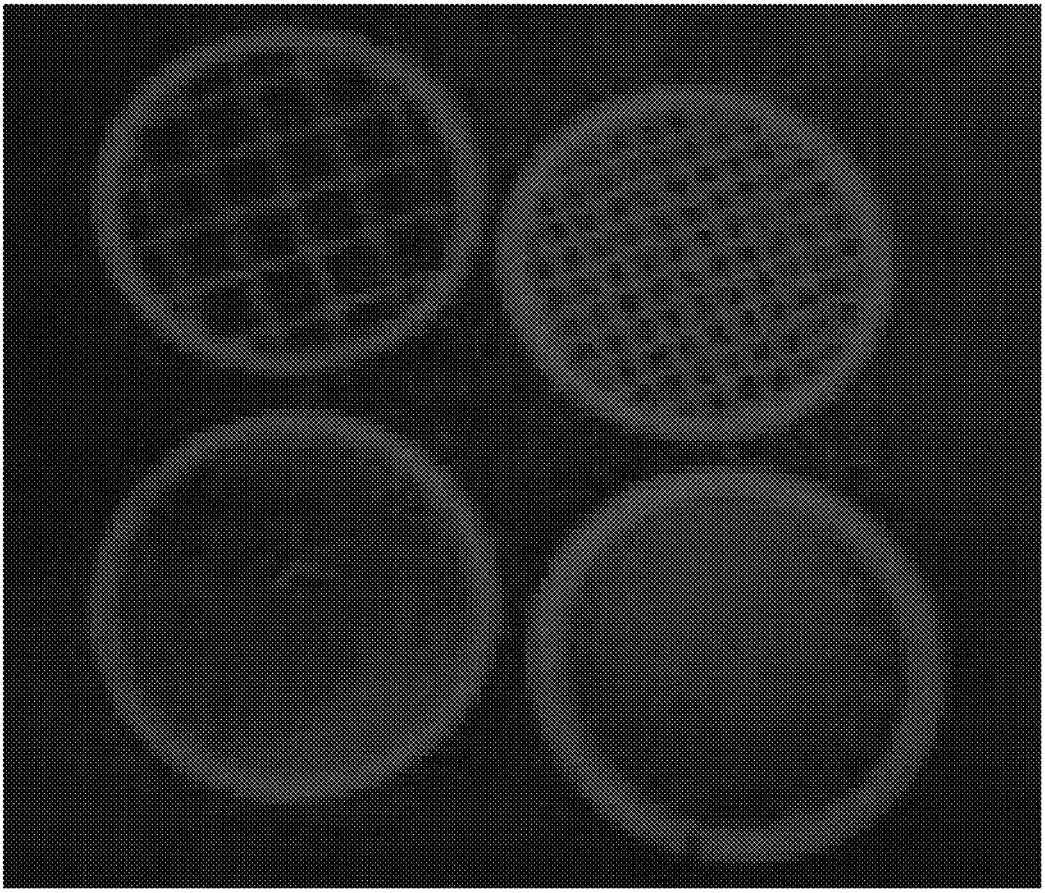
FIG. 15 shows an illustrative image of patterned silicon nitride substrates with a thin gold film in accordance with an embodiment of the invention.

Gold plating of the pore walls allows for the straightforward subsequent use of thiol chemistry for surface chemical functionalization. By choosing complementary pore dimensions and gold film thickness, either by fabricating pores with smaller initial sizes, or by increasing the plating time, this electroless plating process can also be used to physically tune the pore dimensions. This method thus provides access to surfaces that may not be accessible to line-of-sight methods, and it moreover provides control over both surface physicochemical properties and physical dimensions of surface and internal pores. In addition, the method is well-suited for tuning and enhancing the properties and performance of thin film and pore-based devices. FIG. 14 shows an illustration of plated gold of the invention in a solution. FIG. 15 shows a silicon nitride substrate patterned using grids as photomasks for the irradiation of silicon nitride immersed in a 1-alkene in accordance with an embodiment of the invention.

The description of the specific embodiments of the invention is presented for the purposes of illustration. It is not intended to be exhaustive nor to limit the scope of the invention to the specific forms described herein. Although the invention has been described with reference to several embodiments, it will be understood by one of ordinary skill in the art that various modifications can be made without departing from the spirit and the scope of the invention, as set forth.

What is claimed is:

1. A method of plating a thin metal film directly onto a substrate comprising silicon nitride or silicon, said method comprising the steps of:

cleaning the substrate to remove organic material;

etching a surface of the substrate with an etchant to remove an oxygen-containing surface layer to expose an underlying surface of silicon nitride or silicon for direct plating thereupon;

soaking the substrate in at least one bath comprising metal ions following etching to sensitize the exposed surface for plating; and electroless-plating of a precious metal film directly onto the exposed surface of silicon nitride or silicon without any intervening layer in between by bringing into contact said sensitized and exposed surface with a solution containing said precious metal.

2. The method of claim 1, wherein the substrate comprises silicon-rich silicon nitride.

3. The method of claim 1, wherein the etchant is hydrofluoric acid.

4. The method of claim 1, wherein the method further comprises the step of patterning the substrate surface with an organic overlayer by using a spatially selective hydrosilylation reaction.

5. The method of claim 4, wherein the step of patterning the surface with an organic overlayer comprises photochemically attaching the overlayer through initially providing contact between an 1-alkene or 1-alkyne-terminal of the overlayer and the substrate surface.

6. The method of claim 1, wherein the precious metal is gold.

7. The method of claim 1, wherein the method comprises a step of sensitizing the substrate surface with a solution containing tin (Sn) ions before the electroless plating step.

8. The method of claim 1, further comprising electrolessly plating an interior wall in the substrate defining a space obscured by line-of-sight.

9. A method of plating a thin gold film directly onto a substrate comprising silicon nitride or silicon, said method comprising the steps of:

cleaning the substrate to remove organic material with plasma;

etching the surface of the substrate with an etchant to remove an oxygen-containing surface layer to expose an underlying surface of silicon nitride or silicon for direct plating thereupon;

patterning the surface with an organic overlayer by using a spatially selective hydrosilylation reaction;

soaking the substrate using at least one bath comprising metal ions following etching to sensitize the exposed surface for plating; and electroless-plating gold directly onto the exposed surface of silicon nitride or silicon without any intervening layer in between by bringing into contact said sensitized and exposed surface with a gold-containing solution.

10. The method of claim 9, wherein the substrate comprises silicon-rich silicon nitride.

11. The method of claim 9, wherein the etchant is hydrofluoric acid.

12. The method of claim 9, wherein the method comprises a step of sensitizing the substrate surface with a solution containing palladium (Pd) ions before the electroless plating step.

13. The method of claim 9, further comprising electrolessly plating an interior wall in the substrate defining a space obscured by line-of-sight.

* * * * *